US007996924B2

(12) United States Patent
Wright et al.

(10) Patent No.: US 7,996,924 B2
(45) Date of Patent: Aug. 16, 2011

(54) ARTICLES OF APPAREL PROVIDING ENHANCED BODY POSITION FEEDBACK

(75) Inventors: Steven P. Wright, Beaverton, OR (US); Kenneth Todd Craig, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 788 days.

(21) Appl. No.: 11/756,328

(22) Filed: May 31, 2007

(65) Prior Publication Data

US 2008/0295230 A1 Dec. 4, 2008

(51) Int. Cl.
*A41B 11/00* (2006.01)
*A43B 17/00* (2006.01)

(52) U.S. Cl. ..... 2/239

(58) Field of Classification Search ..... 2/239, 240, 2/241, 409; 66/178 R, 182, 183, 184, 185, 66/186, 187, 188; 602/27, 28, 62, 65, 66, 602/30; 36/89, 7.2, 8.1, 8.3, 51
See application file for complete search history.

(56) References Cited

U.S. PATENT DOCUMENTS

| | | | | | |
|---|---|---|---|---|---|
| 1,373,211 | A | * | 3/1921 | Tanner | 602/30 |
| 1,465,970 | A | * | 8/1923 | Cleveland et al. | 602/66 |
| 1,544,934 | A | * | 7/1925 | Prankard | 66/188 |
| 1,811,786 | A | * | 6/1931 | Frei | 66/187 |
| 1,980,486 | A | * | 11/1934 | King et al. | 36/8.1 |
| 1,999,929 | A | * | 4/1935 | Hearn | 2/239 |
| 2,102,368 | A | * | 12/1937 | Martel | 66/182 |
| 2,179,124 | A | * | 11/1939 | Jesnig | 36/8.1 |
| 2,219,235 | A | * | 10/1940 | Morton | 2/239 |
| 2,293,714 | A | * | 8/1942 | Craig et al. | 2/239 |
| 2,334,206 | A | * | 11/1943 | Knohl | 66/187 |
| 2,831,196 | A | | 4/1958 | Scheiber | |
| 2,845,723 | A | * | 8/1958 | Arnold | 36/9 R |
| 2,926,433 | A | * | 3/1960 | Kramer | 36/9 R |
| 2,994,322 | A | * | 8/1961 | Cullen et al. | 602/27 |
| 3,015,943 | A | * | 1/1962 | Loizillon | 66/188 |
| 3,124,945 | A | * | 3/1964 | Moretta | 66/42 R |

(Continued)

FOREIGN PATENT DOCUMENTS

FR 2631523 11/1989

(Continued)

OTHER PUBLICATIONS

Partial International Search Report in corresponding PCT application, International Application No. PCT/US2008/063698, mailed Aug. 11, 2008.

(Continued)

*Primary Examiner* — Alissa L Hoey
(74) *Attorney, Agent, or Firm* — Banner & Witcoff, Ltd

(57) ABSTRACT

Articles of apparel include: (a) a garment structure having one or more fabric elements structured and arranged to provide a close fit to at least one predetermined portion of a body (e.g., area(s) of the body for which enhanced position sensing and/or feedback are desired, such as the lower back, the arch of the foot, etc.); and (b) a body position feedback system engaged with or integrally formed as part of the garment structure. The body position feedback system may apply higher tensile or constricting (compressive) forces to selected portions of the wearer's body, which can help stimulate or interact with nerves and deep tissue receptors located in various portions of the body. The increased forces at selected locations of the body give the wearer sensory feedback regarding the position or orientation of these parts of the body and can improve or accelerate development of "muscle memory."

17 Claims, 17 Drawing Sheets

U.S. PATENT DOCUMENTS

| | | | | | |
|---|---|---|---|---|---|
| 3,350,100 | A | | 10/1967 | Carmines | |
| 3,537,281 | A | * | 11/1970 | Harrington et al. | 66/179 |
| 3,823,712 | A | | 7/1974 | Morel | |
| 4,089,064 | A | * | 5/1978 | Chandler, Jr. | 2/78.2 |
| 4,222,569 | A | | 9/1980 | DeMascolo | |
| 4,322,894 | A | * | 4/1982 | Dykes | 36/114 |
| 4,519,148 | A | * | 5/1985 | Sisco | 36/91 |
| 4,644,940 | A | * | 2/1987 | Nakamura | 602/30 |
| 4,730,625 | A | | 3/1988 | Fraser et al. | |
| 5,009,420 | A | | 4/1991 | Martelli | |
| 5,088,728 | A | | 2/1992 | Deden | |
| 5,103,656 | A | * | 4/1992 | Hanson, II | 66/185 |
| 5,257,969 | A | * | 11/1993 | Mance | 602/28 |
| 5,412,957 | A | * | 5/1995 | Bradberry et al. | 66/178 A |
| 5,445,598 | A | * | 8/1995 | Nguyen-Senderowicz | 602/65 |
| 5,472,414 | A | * | 12/1995 | Detty | 602/27 |
| 5,582,583 | A | | 12/1996 | Ballantyne | |
| 5,603,232 | A | * | 2/1997 | Throneburg | 66/185 |
| 5,617,745 | A | * | 4/1997 | Della Corte et al. | 66/178 A |
| 5,620,413 | A | * | 4/1997 | Olson | 602/65 |
| 5,638,548 | A | | 6/1997 | Kawakami | |
| 5,640,714 | A | * | 6/1997 | Tanaka | 2/22 |
| 5,640,719 | A | | 6/1997 | Ritchie | |
| 5,708,985 | A | * | 1/1998 | Ogden | 2/239 |
| 5,799,328 | A | | 9/1998 | Harlem et al. | |
| 5,823,886 | A | | 10/1998 | Murray | |
| 5,823,980 | A | | 10/1998 | Kopfer | |
| 5,857,947 | A | | 1/1999 | Dicker et al. | |
| 5,913,592 | A | * | 6/1999 | Moore | 36/8.1 |
| 5,928,173 | A | * | 7/1999 | Unruh | 602/30 |
| 5,960,565 | A | * | 10/1999 | Lochbaum | 36/8.1 |
| 6,018,888 | A | * | 2/2000 | Wilkenfeld et al. | 36/8.3 |
| 6,076,284 | A | * | 6/2000 | Terlizzi | 36/103 |
| 6,086,551 | A | | 7/2000 | Allen | |
| 6,092,397 | A | * | 7/2000 | Cortinovis | 66/184 |
| 6,142,967 | A | * | 11/2000 | Couch | 602/66 |
| 6,176,816 | B1 | | 1/2001 | Dicker et al. | |
| 6,195,801 | B1 | | 3/2001 | Meyers | |
| 6,279,164 | B1 | | 8/2001 | Martin | |
| 6,286,151 | B1 | * | 9/2001 | Lambertz | 2/239 |
| 6,314,580 | B1 | | 11/2001 | Greenberg et al. | |
| 6,364,851 | B1 | | 4/2002 | Nafpliotis | |
| 6,375,581 | B1 | | 4/2002 | Urban et al. | |
| 6,539,551 | B1 | | 4/2003 | Jones, Jr. | |
| 6,546,560 | B2 | | 4/2003 | Fusco et al. | |
| 6,641,550 | B1 | * | 11/2003 | Johnson | 602/65 |
| 6,708,348 | B1 | * | 3/2004 | Romay | 2/239 |
| 6,800,063 | B2 | * | 10/2004 | Iwata | 602/23 |
| 6,805,681 | B2 | | 10/2004 | Yokoyama | |
| 6,862,820 | B2 | * | 3/2005 | Farys et al. | 36/51 |
| 6,908,445 | B2 | * | 6/2005 | Watts | 602/28 |
| 7,082,703 | B2 | * | 8/2006 | Greene et al. | 36/89 |
| 7,117,538 | B2 | | 10/2006 | Bosne et al. | |
| 7,192,411 | B2 | * | 3/2007 | Gobet et al. | 602/63 |
| 7,243,444 | B2 | * | 7/2007 | Selner | 36/89 |
| 7,562,541 | B2 | * | 7/2009 | Hermanson et al. | 66/186 |
| 7,614,257 | B2 | * | 11/2009 | Araki et al. | 66/185 |
| 2001/0041855 | A1 | * | 11/2001 | Voskuilen | 602/65 |
| 2002/0078591 | A1 | * | 6/2002 | Morrone | 36/8.3 |
| 2002/0169403 | A1 | * | 11/2002 | Voskuilen | 602/27 |
| 2003/0233062 | A1 | | 12/2003 | McCormick et al. | |
| 2004/0016041 | A1 | | 1/2004 | Uno et al. | |
| 2005/0038367 | A1 | | 2/2005 | McCormick et al. | |
| 2005/0155137 | A1 | * | 7/2005 | Berger | 2/239 |
| 2005/0187071 | A1 | | 8/2005 | Yamashita et al. | |
| 2006/0021112 | A1 | * | 2/2006 | Roser et al. | 2/239 |
| 2006/0026740 | A1 | | 2/2006 | Vargas et al. | |
| 2006/0143801 | A1 | * | 7/2006 | Lambertz | 2/239 |
| 2006/0169004 | A1 | | 8/2006 | Belluye et al. | |
| 2006/0211968 | A1 | * | 9/2006 | Gordon et al. | 602/27 |
| 2006/0217649 | A1 | * | 9/2006 | Rabe | 602/27 |
| 2007/0049856 | A1 | * | 3/2007 | Arensdorf | 602/27 |
| 2008/0120757 | A1 | | 5/2008 | Nakazawa | |
| 2008/0155731 | A1 | * | 7/2008 | Kasahara | 2/240 |
| 2008/0255490 | A1 | * | 10/2008 | Daley | 602/30 |
| 2008/0269655 | A1 | * | 10/2008 | Shoukry | 602/28 |
| 2008/0295216 | A1 | | 12/2008 | Nordstrom et al. | |
| 2009/0000339 | A1 | * | 1/2009 | Dahlgren | 66/187 |
| 2009/0013450 | A1 | * | 1/2009 | Lambertz | 2/239 |
| 2009/0018482 | A1 | * | 1/2009 | Lambertz | 602/65 |
| 2009/0044313 | A1 | * | 2/2009 | Anastsopoulos et al. | 2/241 |
| 2009/0095026 | A1 | * | 4/2009 | Araki et al. | 66/187 |
| 2009/0100715 | A1 | * | 4/2009 | Broadley | 36/102 |
| 2009/0105704 | A1 | * | 4/2009 | Gordon, Jr. | 606/27 |
| 2009/0126081 | A1 | * | 5/2009 | Lambertz | 2/239 |
| 2009/0151051 | A1 | * | 6/2009 | Chen | 2/240 |
| 2009/0158504 | A1 | * | 6/2009 | Sparrow et al. | 2/239 |
| 2009/0165190 | A1 | * | 7/2009 | Araki et al. | 2/240 |
| 2009/0223254 | A1 | * | 9/2009 | Ishida | 66/185 |
| 2009/0276939 | A1 | * | 11/2009 | Sho et al. | 2/239 |
| 2009/0282607 | A1 | * | 11/2009 | Kaneda | 2/239 |
| 2009/0288451 | A1 | * | 11/2009 | Yokoyama | 66/185 |

FOREIGN PATENT DOCUMENTS

| | | |
|---|---|---|
| JP | 2003038207 | 2/2003 |
| JP | 2006225833 | 8/2006 |
| WO | 2006032096 | 3/2006 |

OTHER PUBLICATIONS

English-language translation of Mizuno's "Arch Hammock" Golf Sock product. This product was commercially available prior to the filing date of the present application (5 pages).

Minuno Feb. 23, 2006 Press Release that appears to relate to its "Arch Hammock" Golf Sock product (2 pages).

Physical sample of the Mizuno "Arch Hammock" Golf Sock product; applicants can submit this sample to the Examiner upon request.

Partial International Search Report in a related PCT Application, International Application No. PCT/US2009/063597, mailed Feb. 26, 2010.

International Preliminary Report on Patentability issued in the corresponding PCT Application, International Application No. PCT/US2008/063698, mailed Dec. 10, 2009.

* cited by examiner

ARTICLES OF APPAREL PROVIDING ENHANCED BODY POSITION FEEDBACK

FIELD OF THE INVENTION

The present invention relates to articles of apparel that provide enhanced body position sensory information to the wearer. Structures for providing the enhanced body position information to the wearer may be separate elements engaged with an article of apparel or integrally formed as part of the fabric of the apparel structure.

BACKGROUND

Many athletic activities require the participants to perform the same or similar activities a repeated number of times, both in practice and during competitive events. For example, golfers repeatedly swing golf clubs over the course of a round or a practice session; baseball, softball, or cricket players repeatedly swing a bat or throw a ball over the course of a game or practice; yoga enthusiasts, gymnasts, and dancers repeatedly perform similar routines; basketball players repeatedly shoot free throws and other types of shots; football players repeatedly run, throw, kick, block, rush, run, etc.; sailors, kayakers, canoers, crew team members, or other "boat" based athletes repeatedly perform rowing or other motions; runners have repeated and cyclic arm and leg motions; etc.

Correct body positioning and/or motion during various portions of athletic performances can help the athlete in a variety of ways. For example, proper body positioning and/or posture during an activity can help the athlete: apply or exert a force more efficiently and/or in a better direction with respect to another object; avoid injury due to awkward positioning or landing; prevent muscle soreness; perform a more aesthetically pleasing or sound routine; etc. Trainers and coaches spend a great deal of time helping athletes develop proper body positioning and working on their "form," in order to enhance the athletic performance and to build a repeatable and reliable action.

Working under the watchful eye of a coach or trainer can greatly improve an athlete's form or body positioning, which can result in improved athletic performances. For most people, however, a coach or trainer is not always available, and there often is no great way for the athlete, on his or her own, to check their body positioning and form because many areas of the athlete's body are not visible to him or her during the practice or performance. Human beings cannot readily "feel" the locations of various parts of their body in normal body posture or positions and/or during typical motions (e.g., a human typically cannot "feel" the position of his or her lower back or a position of the foot arch during stances or certain motions). Therefore, an athlete can easily adopt poor posture, body positioning, and/or other form degrading habits over time in a manner that deleteriously affects his/her performance.

SUMMARY OF THE INVENTION

The following presents a general summary of aspects of the present invention in order to provide a basic understanding of the invention and various example features of it. This summary is not intended to limit the scope of the invention in any way, but it simply provides a general overview and context for the more detailed description that follows.

Aspects of this invention relate to garment structures that provide improved sensory feedback to the wearer to better help the wearer understand or "feel" the position of various parts of the body (optionally without overly restricting the wearer's body or forming a motion or movement inhibiting brace structure). Articles of apparel in accordance with some examples of this invention may include: (a) a garment structure having one or more fabric elements, wherein the garment structure is structured and arranged so as to provide a close fit to at least one predetermined portion of a human body (e.g., a close fit (and optionally an at least partially wrapped around fit) to one or more areas of the body for which enhanced position sensing and/or positional feedback are desired); and (b) a body position feedback system engaged with or integrally formed as part of the garment structure (at least at the desired area or areas where enhanced position sensing and/or positional feedback are desired). The body position feedback system may provide and apply higher compressive forces to selected portions of the wearer's body, which can help stimulate or interact with nerves, deep tissue receptors, joint mechanoreceptors, etc. located in various portions of the human body, to better give the wearer sensory response in those areas and feedback as to the position of the selected parts of the body. Materials having higher moduli of elasticity may be used in the body position feedback system to produce the higher compressive forces (and resist tensile stretching of the body position feedback system).

BRIEF DESCRIPTION OF THE DRAWINGS

The present invention is illustrated by way of example and not limited in the accompanying figures, in which like reference numerals indicate the same or similar elements throughout, and in which.

The reader is advised that the various parts shown in these drawings are not necessarily drawn to scale.

DETAILED DESCRIPTION

The following description and the accompanying figures disclose features of body position feedback systems and articles of apparel in accordance with examples of the present invention.

I. General Description of Body Position Feedback Systems and Methods in Accordance with this Invention As described above, humans cannot readily "feel" the locations of various parts of their body in normal body posture or positions and/or during typical motions or activities. For example, a human's back, and particularly the lower back, has a relatively sparse "touch sensing" neural population. The human body core, its positioning, and its motion (including the back), however, are very important for many athletic activities. For example, the body core is a center point of rotation and power generation in a golf swing. Moreover, being able to repeatedly place the body in the proper posture and correctly position the body at the beginning of and over the course of the swing are critical to developing a consistent and repeatable swing (and thereby improving one's golf game).

Figure 1:
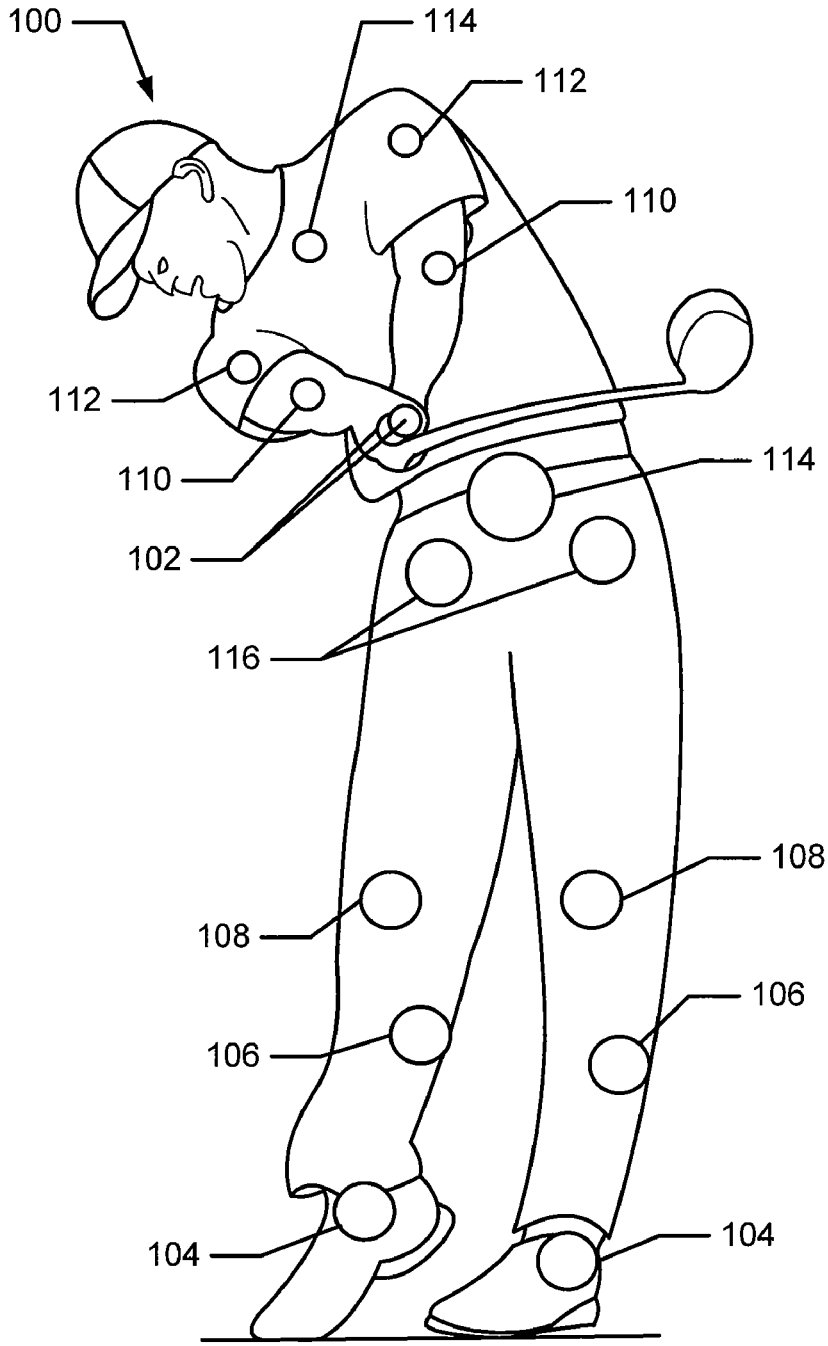
FIG. 1 illustrates an athlete making a golf swing and various zones of the body for which positioning and/or motion can be important during this activity.

FIG. 1 illustrates a golfer 100 in mid-swing. Body positioning at the beginning of the swing (e.g., posture at the address position) and over the course of a swing can be very important to the results achieved. FIG. 1 illustrates various zones or areas of the human body, the positions of which during at least some time during the swing can be important to the results achieved. For a golf swing, these important zones include: the hands 102; the feet and ankles 104; the calves 106; the knees 108; the arms 110; the shoulders 112; the sacrum (lower back) and core 114; and the hips 116. Assistance in properly positioning one or more of these zones at various times during the golf swing (e.g., posture at address, other times over the course of a swing, etc.) can greatly assist in helping athletes repeatedly place the body in the proper posture and correctly position the body over the course of the swing.

Aspects of this invention relate to garments that help make wearers more aware of the positioning of various selected parts of the body, e.g., due to enhanced stimulation of nerves, joint mechanoreceptors, and/or deep tissue receptors at the selected parts of the body. Garments can be designed to closely fit (and optionally at least partially wrap around) one or more of the various areas or zones described above in conjunction with FIG. 1. Additionally, such garments can include body position feedback enhancing structures or regions, e.g., that apply a compressive force along or around various parts of the body (and resist tensile elongation), to enhance somatosensory feedback relating to the position of various parts of the body adjacent the enhanced feedback area of the garment and enhance user "awareness" of the position of these various parts of the body. Such improved "awareness" can help athletes better position themselves, develop "muscle memory," and maintain better positioning over time.

Advantageously, in accordance with at least some examples of this invention, the body position feedback structures or regions will include juxtaposed regions in which compressive forces are applied and regions in which compressive forces are not applied. The differential in the applied compressive forces at the adjacent regions tends to enhance the wearer's feel and awareness of the body position at these locations. Various structures and ways of creating this differential in applied compressive forces at adjacent locations will be described below.

As mentioned above, aspects of this invention relate to body position feedback systems that may be used with or integrated into articles of apparel, such as upper and/or lower torso clothing (e.g., shirts, blouses, tank tops, leotards, leggings, form fitting garments, pants, shorts, skirts, undergarments, etc.); socks or other garments that at least partially contain a human foot or leg; gloves or other garments that at least partially cover or contain at least a portion of a human hand or arm; etc. Special garments may be provided to at least partially contain or fit over or against the desired part of the body, such as a sleeve or wrap for insertion of a leg or arm, garments or wraps to contain or cover any of the areas illustrated in FIG. 1, etc.

A. Feedback Systems Attached to Clothing Structures

First, garment structures having separately engaged body position feedback systems will be described in more detail.

1. Example Body Position Feedback Systems for Engagement with Articles of Apparel Body position feedback systems in accordance with at least some examples of this invention may help stimulate or interact with nerves, joint mechanoreceptors, and/or deep tissue receptors located in various portions of the human body, to better give the wearer feedback as to the position or orientation of various parts of the body. Such body position feedback systems may include: (a) a first material layer having a first modulus of elasticity or resistance to stretching (to thereby apply a compressive force to the wearer's body), wherein the first material layer is made from a textile or polymer material and includes a first opening defined therein; and (b) a second material layer engaged with the first material layer and at least partially covering the first opening, wherein the second material layer is made from a fabric or polymer material, and wherein the second material layer has a second modulus of elasticity or resistance to stretching that is lower than the first modulus of elasticity or resistance to stretching. Optionally, if desired, body position feedback structures in accordance with at least some examples of this invention further may include a third material layer, wherein a first surface of the third material layer is engaged with at least one of the first material layer or the second material layer, and wherein the second material layer is sandwiched between the first material layer and the third material layer. This third material layer, when present, may include a surface having materials suitable to assist in engaging the third material layer with a garment structure. More specific examples and features of example body position feedback systems in accordance with this invention will be described below.

2. Example Articles of Apparel Including Attached Body Position Feedback Systems Body position feedback systems in accordance with examples of this invention may be used in conjunction with a wide variety of different garment structures and/or to enhance position sensing of a variety of different body parts or regions. In general, articles of apparel in accordance with at least some examples of this invention may include: (a) a garment structure having one or more fabric elements, wherein the garment structure is structured and arranged so as to provide a close fit to (and optionally at least partially wrap around) at least one predetermined portion of a human body (e.g., a close fit to one or more areas of the body for which enhanced position sensing and/or feedback are desired); and (b) a body position feedback system engaged with the garment structure (at least at the desired area or areas where enhanced position sensing and/or feedback are desired). If desired, the body position feedback system may have the various structures described above, although it may constitute a simple one layer structure applied to the fabric. In some example structures, at least one portion of the body position feedback system will have a higher modulus of elasticity or resistance to stretching (to thereby apply a compressive force to the body) as compared to that of the fabric element making up the largest proportion of the garment structure and/or as compared to the fabric element(s) that it covers. In some example garment structures, the fabric element(s) of the garment structure and the material(s) of the body position feedback system may be selected such that the body positioning feedback system applies a compressive force to the wearer's body that is at least 10% higher than the compressive force applied by the adjacent fabric elements. In still other example structures, this compressive force differential in the body position feedback region as compared to the immediately adjacent regions (covered by a fabric element) may be at least 25% higher, at least 40% higher, at least 50% higher, at least 75% higher, at least 100% higher, or even at least 150% higher.

In accordance with at least some examples of this invention, at least the first material layer of the body position feedback system will have a continuous structure in a direction so as to extend around a sufficient part of the body for which enhanced position sensing is desired. More specifically, in accordance with at least some examples of this invention, at least a first material layer of the body position feedback system will be sufficiently long so as to extend around a portion of the human body that stretches, elongates, or moves during the activity for which enhanced body position sensing is desired. The first material layer may apply a higher compressive force to the body than that applied by the fabric element making up the largest proportion of the garment structure and/or the fabric element(s) that it covers. In this manner, the stretching, elongation, or moving action of the body against the relatively stretch resistant first material layer will cause some level of compression or resistance to the stretching, elongation, or movement (without substantially impeding, altering, or affecting the desired movement), which helps better stimulate the deep tissue located nerves or other sensory receptors in that area. This stimulation provides sensory feedback to the garment wearer and better makes the wearer aware of the positioning of the targeted part of the body. Repeated stimulation (e.g., during repeated practice, drills, play, etc.) enhances "muscle memory," as the wearer becomes more aware and familiar with the feelings when his or her body is in the proper position. Practice and working with an instructor or coach while wearing garments in accordance with examples of this invention (e.g., to assure proper body positioning and form), can allow athletes or others to better "ingrain" the feel of proper body positioning and develop "muscle memory," which can lead to better and more repeatable body positioning during the desired activities and better performance. Additionally, garment structures in accordance with at least some examples of this invention may be worn by the athlete during actual competition and/or practice.

Body position feedback systems according to examples of this invention may be engaged with the garment structure in any suitable or desired manner without departing from this invention. In some more specific examples, the body position feedback system will include at least one surface that directly engages a surface of the garment structure, and this surface of the body position feedback system may be formed from, include, and/or be modified to include a material that will enable the body position feedback system to be fixed to the garment surface (e.g., an adhesive, such as a urethane based, heat activated adhesive or thermoplastic material, etc.). Heat and/or pressure may be applied to the body position feedback system and/or the garment structure to fix the feedback system to the garment structure (e.g., via one or more lamination procedures, to cure one or more layers of an adhesive or cement material, etc.). Other possible engaging methods include, but are not limited to: sewing or stitching the body position feedback system to the garment structure; engaging the body position feedback system to the garment structure by one or more mechanical connectors, such as snaps, hook-and-loop fasteners systems, other fastener systems, etc.; etc.

More specific examples of articles of apparel in accordance with some examples of this invention now will be described.

a. Garments Including Lower Back Position Feedback Systems

Many athletic activities involve swinging an object or otherwise twisting the body and/or moving the arms, legs, upper torso, and/or body core (e.g., a golf swing, a baseball swing, a cricket swing, throwing a ball, etc.). Proper positioning and/or movement of the body, and particularly the lower back (e.g., part of the body core, the sacrum area, etc.), can influence the results achieved during these activities. Articles of apparel that provide enhanced lower back position feedback according to some examples of this invention may include: (a) a garment structure for covering at least a lower back portion of a human torso (e.g., a shirt, blouse, leotard, tank top, cylindrical tube, an undergarment, etc.), wherein the garment structure includes one or more fabric elements, and wherein the garment structure is structured and arranged so as to provide a close fit to at least the lower back portion; and (b) a lower back position feedback system engaged with the garment structure at the lower back portion, wherein the lower back position feedback system includes at least a first region in the lower back portion that applies a higher compressive force to the wearer's body (e.g., by resisting stretching) than a compressive force applied by the fabric element making up a largest proportion of the garment structure and/or the fabric element(s) that the lower back position feedback system cover (e.g., the fabric element(s) immediately adjacent the lower back position feedback system).

Lower back position feedback systems in accordance with examples of this invention may take on a wide variety of structures and constructions without departing from the invention (including the structures described above). In at least some examples of this invention, the region of the position feedback system that applies the higher compressive forces will extend (e.g., continuously) at least one time across the wearer's lower back portion, from one of the wearer's sides (and the garment sides) to the other. The lower back position feedback system may include one, two, three, or even more portions (optionally interconnected portions) that each extends across the wearer's lower back (and the garment back) from one side to the other. In some example structures, where multiple portions of the feedback system extends across the wearer's lower back, the majority of the length of these various portions will be separated from one another (optionally, vertically separated), e.g., by at least a half inch, by at least an inch, or even by at least two or more inches. The staggered areas of high compressive force applying material and the absence of this material at certain areas leads to staggered areas on the body with stimulated deep tissue receptors and unstimulated areas (the "differential" mentioned above), which can lead to better user feel of the position feedback system and a better wearer sense of the body's positioning (e.g., due to the contrasting and closely located stimulated and unstimulated regions).

Nonetheless, a wide range of structures and constructions for lower back position feedback systems are possible without departing from this invention. As some more specific examples, if desired, the overall length dimension of one or more of the high compressive force applying regions extending across the lower back portion of the garment structure in a direction from one side of the garment to the other may be at least four inches, and in some examples it may be at least seven inches, at least ten inches, at least twelve inches, or even more.

In some example lower back position feedback systems according to this invention, the high compressive force applying region or regions will have an overall length dimension in a direction extending from a first side of the garment structure toward a second side of the garment structure that is at least four times an overall height dimension in a direction perpendicular to the overall length dimension (e.g., up and down the wearer's back). In some more specific examples, this ratio of overall length to overall height (L:H) will be at least 7, at least 10, at least 12, or even greater.

Still additional features and structures for the lower back position feedback system are possible without departing from this invention. For example, when multiple high compressive force applying regions are provided in the feedback system structure, these regions may be located vertically and/or horizontally separated from one another. Moreover, these regions may meet at and/or extend from one or more common base regions (the base region(s) also may be constructed from a high compressive force applying material, e.g., continuous with, the same as, or different from the material of the other high compressive force applying region(s). The base region, when present, may be centrally located in the position feedback system and may be arranged to extend substantially along the spinal or center area of the garment structure. If desired, the entire high compressive force applying material, including the base region and any regions extending therefrom (when present), may be made as a continuous part (e.g., as a single unitary piece, as multiple pieces directly connected together, etc.). This high compressive force applying material also may comprise a single material layer or multiple material layers.

More specific examples of lower back position feedback system structures will be described in more detail below in conjunction with various attached figures.

b. Garments Including Foot Position Feedback Systems

Weight distribution, foot positioning, weight shift, and foot movement also can be important in proper and/or efficient performance of many athletic activities, including activities that include weight transfer, such as swinging or throwing motions, like those mentioned above. Articles of apparel that help provide wearer feedback and better wearer awareness of foot positioning may include: (a) a garment structure for a human foot (e.g., a sock, sleeve, or other article of clothing that at least partially contains the foot), wherein the garment structure includes one or more fabric elements, and wherein the garment structure is structured and arranged so as to provide a close fit to and extend across an arch portion of the foot (from the medial side to the lateral side), an instep portion of the foot (e.g., diagonally across the top of the foot), etc.; and (b) a foot position feedback system engaged with the garment structure at the arch portion and/or instep portion, wherein the foot position feedback system includes a first region in the arch portion and/or the instep portion that applies a higher compressive force to the arch portion and/or the instep portion as compared to force applied by the fabric element making up a largest proportion of the garment structure and/or the fabric element(s) that the feedback system covers (e.g., the fabric element(s) that lie immediately adjacent the feedback system). In such structures, a main portion of the material making up the high compressive force applying region(s) may extend (e.g., continuously, optionally as one or more pieces) from a lateral foot side of the garment structure and/or across an instep (or top) portion of the garment structure, across a footbed (or sole) portion of the garment structure, and to a medial foot side of the garment structure. In at least some example structures according to this aspect of the invention, at least some portion (optionally, a majority) of an instep portion and/or the footbed portion of the garment structure will not be covered by the foot position feedback system (e.g., to help provide and highlight the differential in feel for the stimulated and non-stimulated receptors, as described above). The differential in applied compressive forces for the position feedback regions as compared to the other fabric materials of the garment structures may take on the various values described above (e.g., at least 10% higher, at least 25% higher, at least 40% higher, at least 50% higher, at least 75% higher, at least 100% higher, or even at least 150% higher).

Foot position feedback systems in accordance with at least some examples of this invention may include plural regions that apply a higher compressive force as compared to the compressive force applied by the fabric element making up the largest proportion of the garment structure and/or the fabric element(s) that the feedback system covers (e.g., located immediately adjacent the feedback system). These various regions may be separated from one another, joined with one another, or continuous with one another (or at least continuous with the arch oriented high compressive force applying region, e.g., as a "wing" or projection extending from the arch oriented high compressive force applying region). In addition to or as an alternative to the region extending across the arch portion of the wearer's foot, high compressive force applying regions may be provided along one or more of: a medial ankle portion of the garment structure, a lateral ankle portion of the garment structure, a heel portion of the garment structure, across an instep portion of the garment structure, etc. Foot position feedback systems may have the same general structure as the various lower back position feedback systems described above (e.g., a multilayered structure, a single layer structure, etc.), if desired.

More specific examples of foot position feedback system structures will be described in more detail below in conjunction with various attached figures.

3. Example Methods of Making Body Position Feedback Systems and Articles of Apparel Including Such Systems Additional aspects of this invention relate to methods of making body position feedback systems and/or articles of apparel including such systems, e.g., of the various types described above. Methods of making body position feedback systems of the types described above (and described in more detail below) may include: (a) providing a first material layer having a first compressive force applying capability (e.g., resistance to stretching) (e.g., by making the first material layer (e.g., cutting it from a blank), by obtaining it from another source, etc.), wherein the first material layer is made from a textile and/or polymer material, and wherein the first material layer includes a first opening defined therein; and (b) engaging a second material layer with the first material layer so as to at least partially cover the first opening, wherein the second material layer is made from a fabric or polymer material, wherein the second material layer has a second compressive force applying capability (e.g., resistance to stretching) that, in at least some structures, is lower than that of the first material layer. Optionally, methods in accordance with at least some examples of this invention further may include: (c) engaging a third material layer with at least one of the first material layer or the second material layer, wherein the second material layer is sandwiched between the first material layer and the third material layer; and (d) treating or providing an exposed surface of the third material layer with a material for engaging the third material layer with a garment structure (e.g., an adhesive material, etc.). If desired, at least portions of the first and third material layers may be formed of and/or include suitable materials to enable these layers to be laminated together with at least some portion of the second material layer located therebetween.

Methods of making articles of apparel in accordance with at least some examples of this invention, e.g., of the types described above, may include: (a) providing a garment structure including one or more fabric elements (e.g., by manufacturing it, obtaining it from another source, etc.), wherein the garment structure is structured and arranged so as to provide a close fit to at least one predetermined portion of a human body; and (b) engaging a body position feedback system with the garment structure (e.g., by lamination, by adhesives or cements, by sewing or stitching, by mechanical connectors, etc.). The body position feedback systems may include, for example, any of the various types described above, including single layer or material structures, multilayer or multi-material structures, laminate structures, etc.

B. Feedback Systems Integrally Formed in Clothing Structures

1. Example Articles of Apparel Including Integrally Formed Body Position Feedback Systems Rather than attaching one or more structures at selective position(s) on fully formed or substantially fully formed articles of clothing, body position feedback systems in accordance with at least some examples of this invention may be integrally formed as part of the clothing structure. This may be accomplished in various ways, including, for example, one or more of the following: by making one or more areas or regions in the garment structure from a different material as compared to other areas of the garment structure; by using different knitting, stitching, weaving, or other textile construction features in one or more areas or regions of the garment structure as compared to other areas of the garment structure; by providing different thicknesses and/or texturing in one or more areas of the garment structure as compared to other areas of the garment structure; etc.

In general, at least some example articles of apparel in accordance with this aspect of the invention may include: (a) a garment structure made from one or more fabric elements, wherein the garment structure is structured and arranged so as to provide a close fit to at least one predetermined portion of a human body; and (b) a body position feedback system integrally formed in the garment structure (e.g., in the ways described above). The body position feedback system in accordance with at least some examples of this aspect of the invention may include: (a) a first region having a first compressive force applying capability (e.g., resistance to stretching), wherein this first compressive force applying capability is higher than a compressive force applying capability of the fabric element making up a largest proportion of the garment structure and/or that of the fabric element(s) immediately surrounding the first region, and (b) a second region at least partially surrounded by the first region, wherein the second region has a second compressive force applying capability that is different from the first compressive force applying capability, and wherein the second compressive force applying capability is higher than that of the fabric element making up the largest proportion of the garment structure. The compressive force applying capability of the first region may be higher than or lower than the compressive force applying capability of the second region (although, if desired, in some example structures, these two regions may be the same or substantially the same and/or may have the same or substantially the same compressive force applying capability).

More specific examples of articles of apparel in accordance with this aspect of the invention now will be described.

a. Garments Including Integrally Formed Lower Back Position Feedback Systems

As described above, many athletic activities involve swinging an object or otherwise twisting the body and/or moving the arms, legs, upper torso, and/or body core (e.g., a golf swing, a baseball swing, a cricket swing, throwing a ball, etc.). Proper positioning and/or movement of the body, and particularly the lower back (e.g., part of the body core, the sacrum area, etc.), can influence the results achieved during these activities. Articles of apparel that provide enhanced lower back position feedback according to some examples of this aspect of the invention may include: (a) a garment structure for covering at least a lower back portion of a human torso, wherein the garment structure includes one or more fabric elements, and wherein the garment structure is structured and arranged so as to provide a close fit to at least the lower back portion; and (b) a lower back position feedback system integrally formed in the garment structure at the lower back portion. This lower back position feedback system may include at least a first region in the lower back portion, wherein a largest dimension of the first region extends across the lower back portion of the garment structure in a direction from a first side of the garment structure toward a second side of the garment structure, and wherein the first region applies a higher compressive force to the wearer's body (e.g., by resisting stretching) than a compressive force applied by a fabric element making up a largest proportion of the garment structure and/or that applied by the fabric element(s) immediately surrounding the first region. The different region(s) applying the higher compressive force may be integrally provided as part of the garment structure in any desired manner, for example, in the various ways described above (e.g., by incorporating different materials (materials having different elasticities) into the garment structure; by using different stitching, knitting, or weaving patterns; by providing different thicknesses and/or texturing of the material; etc.). Other ways of altering the structure of the high compressive force applying region and/or other portions of the garment structure also may be used without departing from this invention.

The higher compressive force applying region or regions may be provided in any desired sizes, shapes, and/or locations in the lower back area of the garment structure, including in the sizes, shapes, and/or locations as described above in conjunction with the separate and attached lower back position feedback systems (and as will be described in more detail below in the detailed description of specific example structures according to this invention).

b. Garments Including Integrally Formed Foot Position Feedback Systems

As also described above, foot positioning and movement also can be important in proper and/or efficient performance of many athletic activities, including activities that include a swinging or throwing motion, like those mentioned above. Articles of apparel in accordance with this aspect of the invention that help provide wearer feedback and better wearer awareness of foot positioning may include: (a) a garment structure for a human foot, wherein the garment structure includes one or more fabric elements, and wherein the garment structure is structured and arranged so as to provide a close fit to and extend across an arch portion and/or an instep portion of the foot; and (b) a foot position feedback system integrally formed in the garment structure at the arch portion and/or instep portion. This foot position feedback system may include at least a first region that extends across the arch portion and/or the instep portion from a medial side of the garment structure, across a footbed portion and/or an instep portion of the garment structure, and to a lateral side of the garment structure, wherein the first region has a higher compressive force applying capability than that of the fabric element making up a largest proportion of the garment structure and/or that of the fabric element(s) immediately surrounding the first region.

The different region(s) providing the higher compressive force application (e.g., resistance to stretching) may be integrally provided as part of this foot-containing garment structure in any desired manner, for example, in the various ways described above (e.g., by incorporating different materials (materials having different elasticities) into the garment structure; by using different stitching, knitting, or weaving patterns; by providing different thicknesses and/or texturing of the material; etc.). Other ways of altering the structure of the higher compressive force applying region and/or other portions of the garment structure also may be used without departing from this invention.

The higher compressive force applying region or regions may be provided in this garment structure in any desired sizes, shapes, and/or locations with respect to the foot-containing portion of the garment structure, including in the sizes, shapes, and/or locations as described above in conjunction with the separate and attached foot position feedback systems (and as will be described in more detail below in the detailed description of specific example structures according to this invention).

2. Example Methods of Making Articles of Apparel Including Integrally Formed Body Position Feedback Systems Additional aspects of this invention relate to methods of making articles of apparel including integrally formed body position feedback systems, e.g., of the various types described above. Methods of making body position feedback systems of the types described above (and described in more detail below) may include: (a) forming a garment structure including one or more fabric elements, wherein the garment structure is structured and arranged so as to provide a close fit to at least one predetermined portion of a human body; and (b) integrally forming a body position feedback system as part of the garment structure. The body position feedback system according to at least some examples of this aspect of the invention may include: (a) a first region having a first compressive force applying capability, wherein the first region applies a higher compressive force than that applied by the fabric element making up a largest proportion of the garment structure and/or the fabric element(s) immediately surrounding the first region, and (b) a second region at least partially surrounded by the first region, wherein the second region has a second compressive force applying capability that is different from the first compressive force applying capability, and wherein the compressive force applied by the second region is higher than that applied by the fabric element making up the largest proportion of the garment structure. The compressive force applied by the first region may be higher than or lower than that applied by the second region (although, if desired, these regions may apply the same or substantially the same compressive force, in at least some example structures according to this invention).

The different region(s) providing the higher compressive forces may be integrally provided as part of the garment structures in any desired manners, for example, in the various ways described above (e.g., by incorporating different materials (materials having different elasticities) into the garment structure at selected locations; by using different stitching, knitting, or weaving patterns; by providing different material thicknesses and/or texturing; etc.). When multiple regions of higher compressive force application are provided, the different regions may be constructed in the same manner or in different manners without departing from this invention.

Given the general description of various examples and aspects of the invention provided above, more detailed descriptions of various specific examples of body position feedback systems and garment structures according to the invention are provided below.

II. Detailed Description of Example Body Position Feedback Systems, Articles of Apparel, and Methods According to the Invention The following discussion and accompanying figures describe various example body position feedback systems, articles of apparel, and methods of making these items in accordance with the present invention. When the same reference number appears in more than one drawing, that reference number is used consistently in this specification and the drawings to refer to the same or similar parts throughout.

Figure 2B:
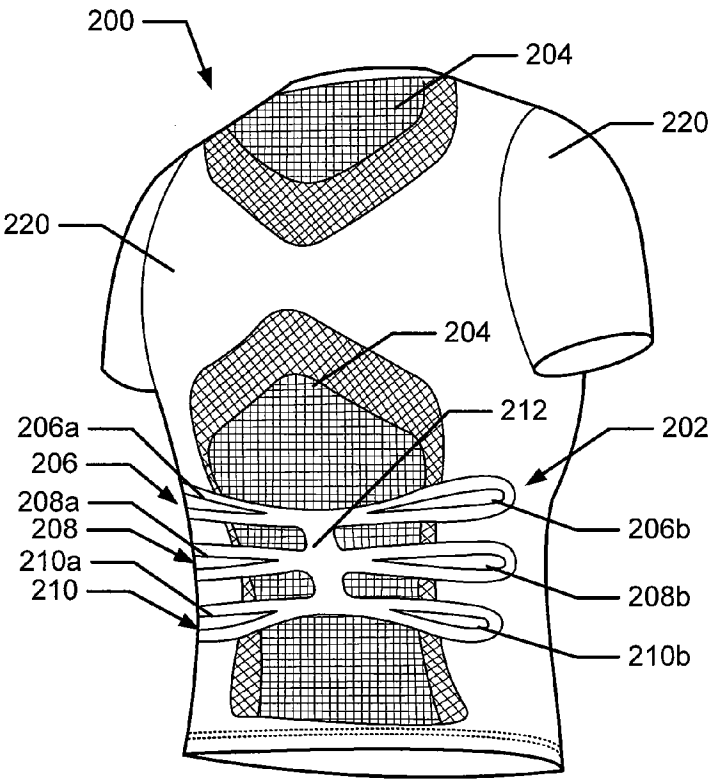
FIGS. 2A and 2B illustrate an example garment structure including a lower back position feedback system according to one example of this invention.
Figure 2A:
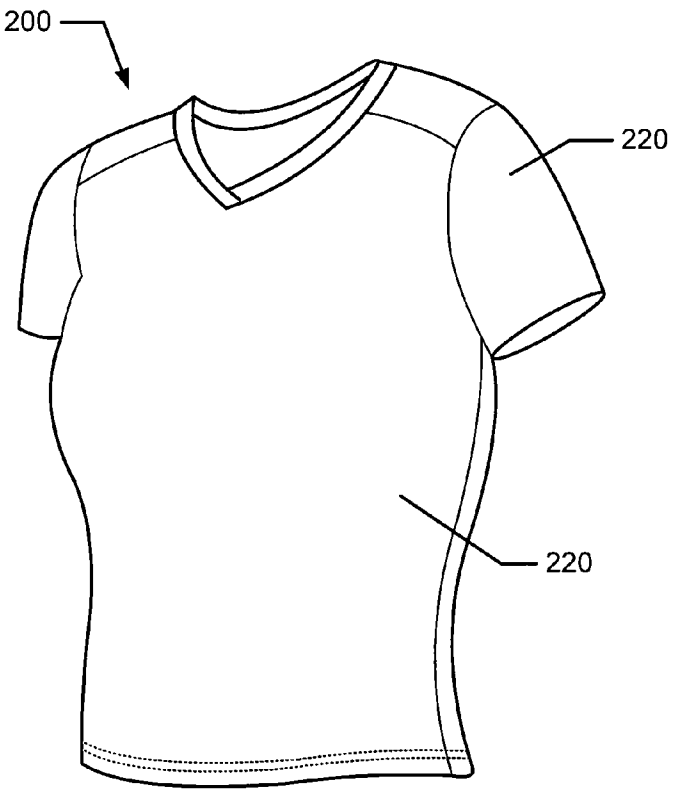

FIGS. 2A and 2B illustrate the front and back, respectively, of a garment structure 200 including an example body position feedback system 202 in accordance with this invention. In this example structure 200, the body position feedback system 202 is designed and located in the garment structure 200 to provide the wearer with information regarding the positioning of the lower back or sacrum area of the body.

The garment structure 200 may be made from one or more fabric elements, e.g., in a conventional manner, from conventional materials, and/or of a conventional construction (e.g., using any desired number of individual fabric elements or pieces 220 engaged together via sewing or in another desired manner), without departing from this invention. In some examples, the garment structure 200 may be made at least in part from an elastomeric material, such as a spandex material, or other material that provides a tight, close fit over the body or at least over a portion of the body where the body position feedback system 202 is to be located (in the lower back or sacrum area of the body core, in this illustrated example structure 200). In the example structure 200 illustrated in FIG. 2B, the rear portion of the garment structure 200 includes fitted areas 204 that may help position the body position feedback system 202 and hold it in a close fitting relationship with respect to the wearer's body at the desired position. Alternatively, if desired, the entire garment structure 200 may be made to closely fit the wearer's body such that individual fitted areas 204 can be omitted. As one more specific example, the base fabric of at least part of the garment structure 200 may be a DRI-FIT® fabric material of the type commercially available from NIKE, Inc. of Beaverton, Oreg. Alternatively, if desired, areas 204 may be made from a mesh material to provide targeted cooling in these (or other) selected areas of the body.

The body position feedback system 202 in this example structure 200 includes various vertically staggered regions 206, 208, and 210 that extend across the lower back from one side of the garment structure 200 to the other. The body position feedback system 202, including at least one of the regions 206, 208, and 210, will have a higher "modulus of elasticity" (e.g., resistance to stretching, compressive force applying capability, etc.) as compared to the modulus of elasticity (e.g., resistance to stretching, compressive force applying capability, etc.) associated with a material or structure making up the largest proportion of the garment structure 200 and/or the material or structure that the feedback system 202 covers. While the body position feedback system 202 can take on a wide variety of sizes and shapes without departing from this invention, as illustrated in the example structure 200 of FIG. 2B, at least some portions of the body position feedback system 202 will have a continuous structure in a direction so as to extend around (or wrap around) a sufficient part of the body for which enhanced position sensing is desired.

For example, FIG. 2B illustrates that each of regions 206, 208, and 210 extends across the lower back and at least partially around the sides of the garment structure 200. In this structure 200, at least one of the regions 206, 208, and 210 will have a sufficient overall length (dimension "L" from one free end of a region 206, 208, and/or 210 to the other free end in a direction perpendicular to the center back direction of the garment structure 200 see FIG. 3D) so as to extend or wrap around the desired portion of the body (the lower back, in this example). The regions 206, 208, and/or 210 may be arranged to provide feedback associated with specific targeted body parts, such as one or more vertebrae or other areas of the lumbar or core area of the body. During the desired activity (e.g., when at the golf ball address position, during a golf swing, etc.), the lower back (or other portion of the body) will stretch or move against the relatively high stretch resistance or compressive force associated with the body position feedback system 202. Because of its higher resistance to stretching, the regions 206, 208, and/or 210 of the body position feedback system 202 will cause some level of compression or resistance to the stretching or movement (without substantially impeding, altering, or affecting the desired movement), which helps better stimulate the deep tissue located nerves or sensory receptors in the wearer's lower back. This stimulation provides sensory feedback to the garment wearer and better makes the wearer aware of the positioning of the targeted part of the body.

Figure 3A:
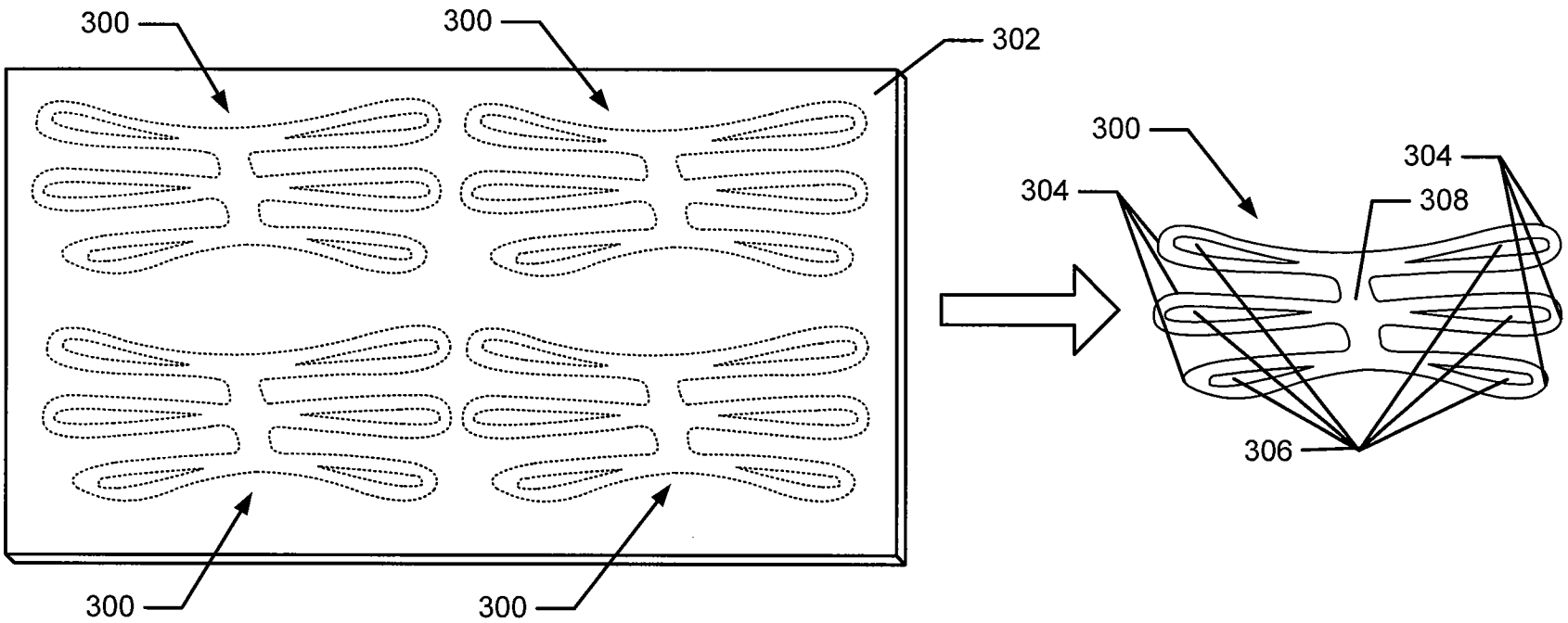
FIGS. 3A through 3F illustrate example methods of making a body position feedback system according to one example of this invention.
Figure 3B:
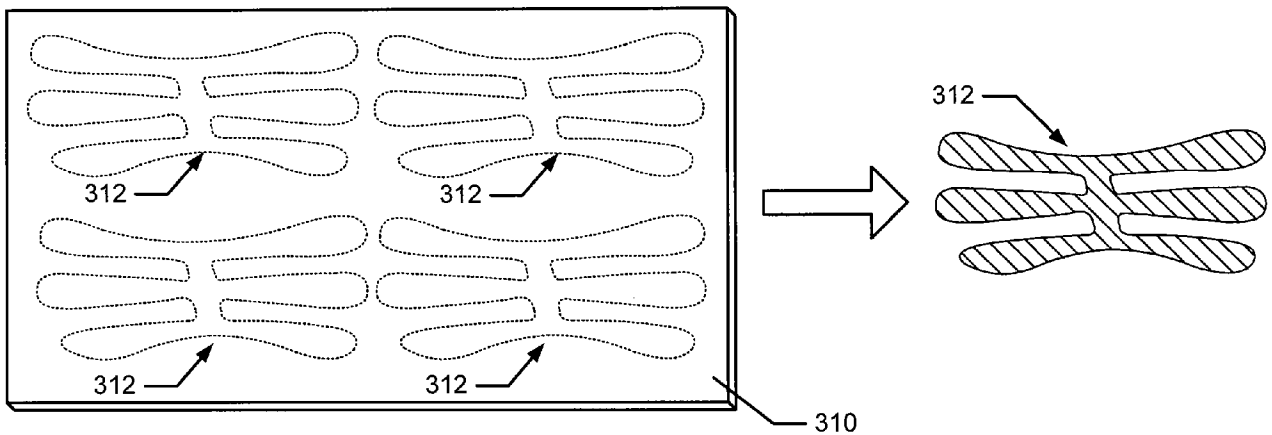
Figure 3C:
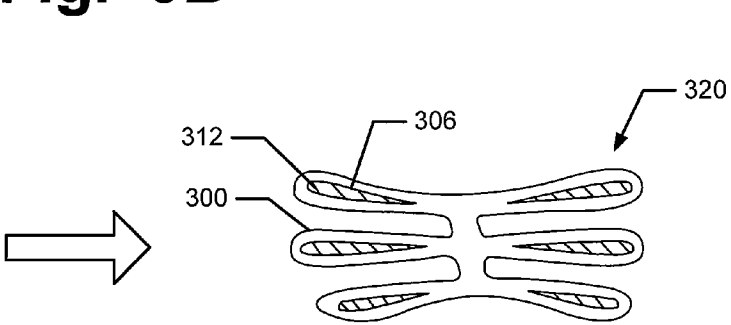
Figure 3D:
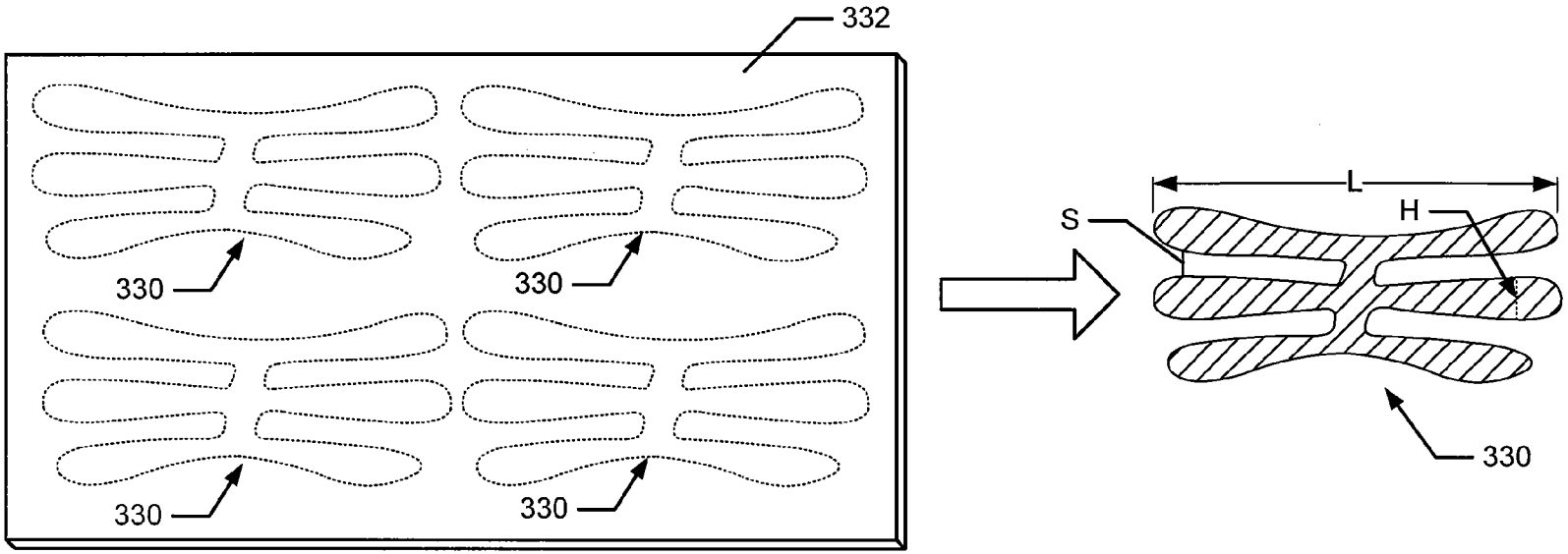

As shown in FIGS. 2B and 3D, the largest continuous dimensions of the high compressive force applying regions 206, 208, and 210 (length dimension "L") in this example structure 200 extend across the lower back portion of the garment structure 200 in a direction from one side of the garment structure 200 toward its opposite side. Each region 206, 208, and 210 includes separate end regions or projections (206*a*, 206*b*, 208*a*, 208*b*, 210*a*, and 210*b*), and the end regions or projections 206*a*, 206*b*, 208*a*, 208*b*, 210*a*, and 210*b* within each region 206, 208, and 210, respectively, are connected to one another in this example structure 200 by a common base region 212. Like the regions 206, 208, and 210, the common base region 212 may be made of a material having a higher stretch resistance than that of the fabric element making up the largest proportion of the garment structure 200 and/or that of the material(s) that it covers. This base region 212 may be centered (or substantially centered) along the spinal or central back region of the garment structure 200. While not necessary in all body position feedback system structures according to the invention, base region 212 holds regions 206, 208, and 210 together, which can assist in positioning the feedback system 202 on the garment 200 and manufacturing the overall garment 200.

As noted above, in this illustrated example structure 200, at least one of the regions 206, 208, and 210 will have a sufficient overall length (dimension "L" from one free end of a region 206, 208, and/or 210 to the other—see FIG. 3D) so as to extend around the desired portion of the body (the lower back, in this example). In this manner, the regions 206, 208, and/or 210 will apply a stretch or movement resisting force (or a compressive force) to that portion of the body. This overall length dimension "L" may vary, e.g., depending on the garment size and/or the portion of the body to be contained (e.g., at least 4 inches, at least 7 inches, at least 10 inches, at least 12 inches, or even more). Moreover, in at least some example structures 200, this length dimension L will be substantially greater than the overall height dimension "H" of the corresponding regions 206, 208, and/or 210 (e.g., the height dimension "H" is the largest dimension of the regions 206, 208, and/or 210 (exclusive of any base region 212) in a direction parallel to the center back portion of the garment structure 200 and/or in a direction perpendicular to dimension "L"—see FIG. 3D). In at least some example structures according to this invention, the L:H ratio may be at least 4, and in some structures, it may be at least 7, at least 10, at least 12, or even more.

FIG. 2B further illustrates that the ends of the higher compressive force applying regions 206, 208, and 210 are separated from one another (indeed, the regions 206, 208, and 210 are separated from one another over a majority of their lengths, even over 75%, 85%, or even more of their lengths). This separation provides several adjacent areas with differently applied compressive forces (the "differential" described above), which can further enhance the wearer's "feel" and awareness of the body position. Any desired distance or amount of separation may be used without departing from this invention. As some more specific examples, the separation distance "S" (exclusive of the common base region 212 in this illustrated example structure 202—see FIG. 3D) may be within the range of 0.25H to 2H, and in some structures, within the range of 0.5H to 1.5H or even 0.75H to 1.25H.

As mentioned above, body position feedback systems in accordance with this invention may be separately attached to a garment structure (e.g., overlaying one or more fabric elements of a conventional article of apparel structure, etc.) or it may be integrally formed as part of the garment structure. Both of these types of body position feedback systems may take on a wide variety of different forms and/or constructions without departing from this invention. One example of a suitable body position feedback system (e.g., system 202 of FIGS. 2A and 2B) and its construction and incorporation into an article of apparel structure is described in more detail below in conjunction with FIGS. 3A through 3F.

The body position feedback system constructed by the method illustrated in FIGS. 3A through 3F is a multilayer construction that may be separately applied to an existing garment structure (e.g., a shirt, tank top, undergarment, leotard, etc.). FIG. 3A illustrates production of a first layer 300 of the example body position feedback system structure 202 of FIG. 2B. As shown, in this step, one or more first layer members 300 are cut out from a larger blank or piece of material 302. Any desired type of cutting operation may be utilized without departing from the invention, including, for example, die cutting, laser cutting, hand cutting, and the like. Also, any desired type of material 302 may be used without departing from this invention. In this illustrated example, the material 302 may be a material having a higher modulus of elasticity (e.g., more resistant to tensile stretching forces and/or providing a higher compression force) as compared to that of the fabric elements making up other portions of the garment structure (e.g., compared to the stretch resistance or compressive force applying capability for the spandex, cotton, polyester, or other fabric elements 220 making up the garment structure 200). As some more specific examples, material 302 may be materials commonly used in tackle twill production, a canvas type material, a polyester type material, a gygli material, etc. In some structures, the material 302 will be made from or contain a suitable material so as to allow first material layer 300 to be joined to another material later in the body position feedback system construction process (e.g., by lamination processes, through application of heat and/or pressure, by adhesives, etc.).

This illustrated example structure 300 includes plural regions of high stretch resistance connected by a common base member 308, like the structure illustrated in FIG. 2B. Each individual projection or end region 304 of this example structure 300 includes an opening 306 cut therein. Additionally or alternatively, if desired, the higher compressive force applying material layer 300 may be made from multiple pieces joined together without departing from this invention (e.g., joined by sewing or stitching; adhesives or cements; mechanical connectors (such as hook-and-loop fasteners); etc.).

FIG. 3B illustrates another step in this example process for producing body position feedback systems. This step is a material 310 cutting step like that described above in conjunction with FIG. 3A, but in this instance, the material 310 forms a second layer of the overall body position feedback system structure 202. Any desired type of cutting operation, including those described above in conjunction with FIG. 3A, may be used for this step without departing from the invention. In general, the material 310 is cut into one or more second layer members 312 having generally the same size and shape as the first layer member 300, but, if desired, the members 312 may be of somewhat different size (e.g., somewhat smaller) and/or somewhat different shape.

The second material layer 312 may be made from any desired material 310 without departing from this invention, including any type of material conventionally used in garment and apparel manufacture. In at least some examples of this invention, the second material layer 312 will be made from a flexible material, such as cotton, polyester, etc., and optionally from the same material included in at least one of the other fabric elements 220 of the garment structure 200. While in some example structures the second material layer 312 may be made from a material having a higher resistance to stretching than that of the fabric element making up the largest proportion of the garment structure 200 and/or a higher resistance to stretching than the first material layer 300, in this illustrated example structure the second material layer 312 will have the same or a lower resistance to stretching than the first material layer 300. As some more specific examples, the second material layer 312 may be made from a mesh material, such as high performance sweat management materials (e.g., thin, lightweight fabrics made from or containing polyester microfibers, polyester microfiber/cotton blends, polyester microfiber/cotton/spandex blends, polyester/spandex blends, and the like), such as "Sphere Dry" polyester knit materials and/or a Dri-FIT® polyester materials, e.g., as included in various commercial products available from NIKE, Inc., of Beaverton, Oreg. (this same material or similar materials also may be used as other fabric elements 220 in the overall garment structure 200).

Once the material layers 300 and 312 are cut from their respective blanks 302 and 310, they may be joined to one another as illustrated in FIG. 3C to thereby build a body position feedback base member 320. Any desired manner of connecting these layers 300 and 312 together may be used without departing from this invention, including, for example, one or more of: sewing or stitching; adhesives or cements; lamination processes; etc. As some more specific examples, the layers 300 and 312 may be joined to one another in manners used in conventional tackle twill construction and manufacture. They also may be joined together using heat and pressing technology as is conventionally known and used in the art.

FIG. 3C illustrates that the material of the second layer 312 extends over and covers the openings 306 in the first material layer 300. Using a flexible, lightweight, and/or low compressive force applying material (as compared to material layer 300) and/or a mesh material as the second material layer 312 can provide certain advantages in an overall garment structure including a multilayer body position feedback system of the type constructed by the method of FIGS. 3A through 3F. For example, a lightweight mesh or other material for second material layer 312 can help prevent or reduce excessive heat buildup that may result due to the presence of the first material layer 300 (e.g., if the first material layer 300 is not very air permeable). Additionally or alternatively, if desired, use of a lightweight and/or flexible material for material layer 312 can help the overall body position feedback base member 320 better move and/or flex with the wearer's body (at least in directions other than the general longitudinal or length dimensions of the high stretch resistant material regions), to thereby help avoid uncomfortable bunching, folding, and the like.

FIGS. 3B and 3C illustrate a single second material layer 312 for engaging the first material layer 300 and completely covering all of the openings 306. This is not a requirement. Rather, if desired, plural second material layers 312 may be provided and separately attached to the first material layer 300, e.g., each second material layer piece 312 may cover only one or fewer than all of the openings 306, multiple second material layers 312 may cover a single opening, etc. When plural second material layers 312 are present, they may overlap, partially overlap, and/or remain separated from one another without departing from this invention.

FIG. 3D illustrates production of another material layer 330 that may be incorporated into a body position feedback system in accordance with at least some examples of this invention. This layer 330, a base layer, may be cut from a blank 332 in generally the same size and shape as the first material layer 300 (optionally, a bit larger), using the same or similar techniques to those described above. The base layer 330 may be made from any desired material 332 without departing from this invention. Various example features of this base layer 330 will be described in more detail below in conjunction with FIGS. 3E and 3F.

The base layer 330 need not be the same shape as the other layer 300. For example, if desired, the base layer 330 may simply be a large block of material to which the other layers can be easily applied (as described below) without the need to precisely align the various parts. Multipart constructions for base layer 330 (multiple base layer parts to engage a single layer 300) also may be used without departing from this invention.

Figure 3E:
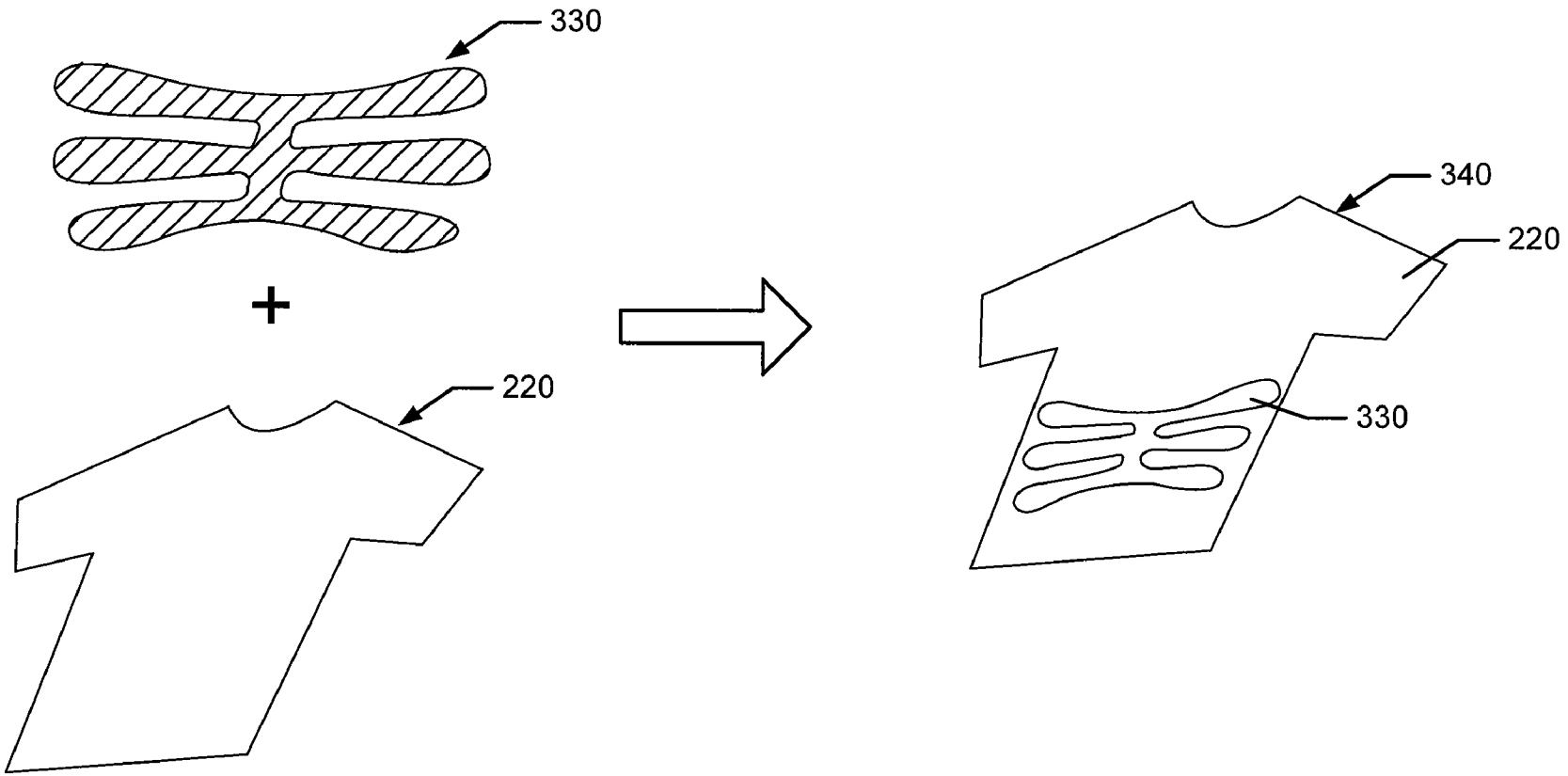

In the next step in this illustrated example procedure, as illustrated in FIG. 3E, the base layer 330 is applied to one or more fabric elements of a garment structure, e.g., like fabric elements 220 of garment structure 200 described above in conjunction with FIGS. 2A and 2B. Any manner of applying the base layer 330 to the fabric element(s) 220 may be used without departing from this invention. For example, if desired, one surface of the base layer 330 may include (or be treated to include) adhesives or other materials to enable the base layer 330 to be applied to the fabric element(s) 220 using heat, pressure, and/or other adhesive curing and/or lamination techniques. As other examples, the base layer 330 may be engaged with the fabric element(s) 220 by sewing or stitching, by mechanical connectors (such as hook-and-loop fasteners), and the like. The combined garment structure with the base layer 330 applied thereto is illustrated in FIG. 3E by reference number 340.

Figure 3F:
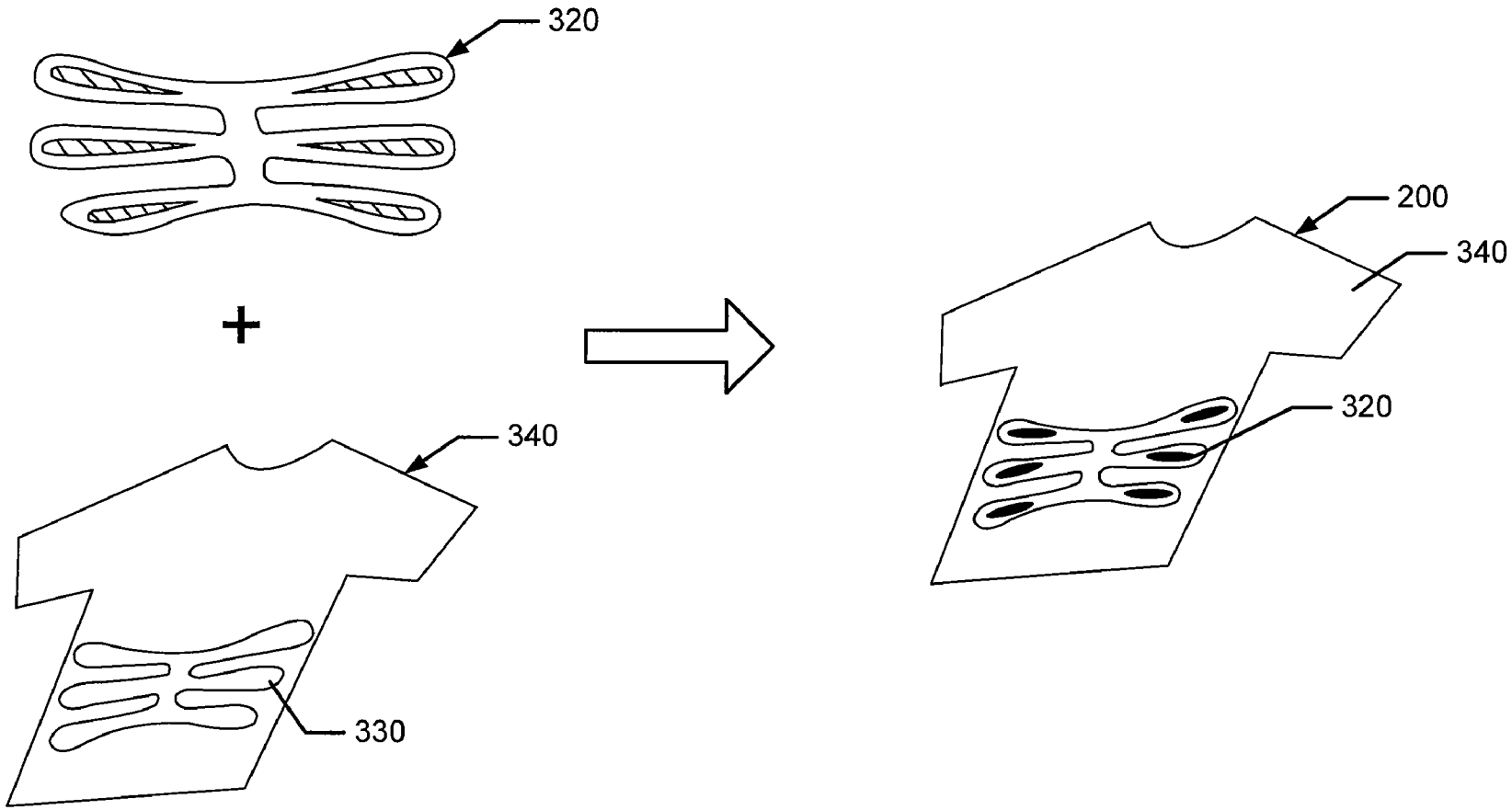

Next, as illustrated in FIG. 3F, the body position feedback base 320 is engaged with the garment base structure 340 over the base layer 330 to produce the final garment structure (e.g., like the garment structure 200 illustrated in FIGS. 2A and 2B). Any desired manner of engaging the body position feedback base 320 with the base layer 330 on the garment base structure 340 may be used without departing from this invention. For example, if desired, the exposed surface of the base layer 330 may include adhesives or other materials (or treated to include such materials) to enable the body position feedback base 320 to be applied to the base layer 330 using heat, pressure, and/or other adhesive curing and/or lamination techniques. As other examples, the body position feedback base 320 may be engaged with the base layer 330 by sewing or stitching, by mechanical connectors (such as hook-and-loop fasteners), and the like. In one example structure, base layer 330 and first material layer 300 will be made and/or include materials that allow them to be engaged together, e.g., using heat, pressure, and/or lamination processes. The base layer 330 and the first material layer 300 also may be made from thermoplastic polymeric materials of the type commercially available from Bemis Associates, Inc. of Shirley, Mass., United States, and they may held together by the adhesive properties of these Bemis materials. Gygli materials and/or materials commercially available from Framis Italia SpA (of Gaggiano, Italy) also may be used for such laminated structures.

Those skilled in the art will appreciate that the various methods described above may be varied significantly without departing from this invention. For example, while various independent steps are described in conjunction with FIGS. 3A through 3F, the steps may be changed in order, combined, include additional features, performed simultaneously, performed by one or more independent parties, or the like, without departing from this invention. For example, if desired, the multi-layered body position feedback system may be fully constructed independent of the garment structure and then, after its construction (e.g., including all layers), it may be applied to the garment structure as a single element (e.g., in a single lamination, heating, and/or pressing step, via sewing, etc.). As another example, if desired, the entire feedback system structure may be built up using the garment as a base material (e.g., first applying the base layer 330 to the garment, applying the second layer 312 to the base layer 330, and then applying the first layer 300 over the second layer). As yet another example, if desired, one or more of the layers (e.g., base layer 330, second material layer 312, etc.) may be omitted without departing from the invention. If desired, a single layer (e.g., layer 330 and/or layer 300) alone may form the entire body position feedback structure. Other modifications also are possible.

When the overall body position feedback system is less air permeable than other fabric elements of the garment structures (including the fabric elements immediately adjacent the feedback system), this can have an advantageous effect. The decreased air permeability of the higher compressive force applying regions can cause some localized sweating at these areas. The differential created by the presence of sweat in the higher sweating areas can further enhance the differential feel, and thus the wearer's feel and awareness of his/her body position.

Figure 4:
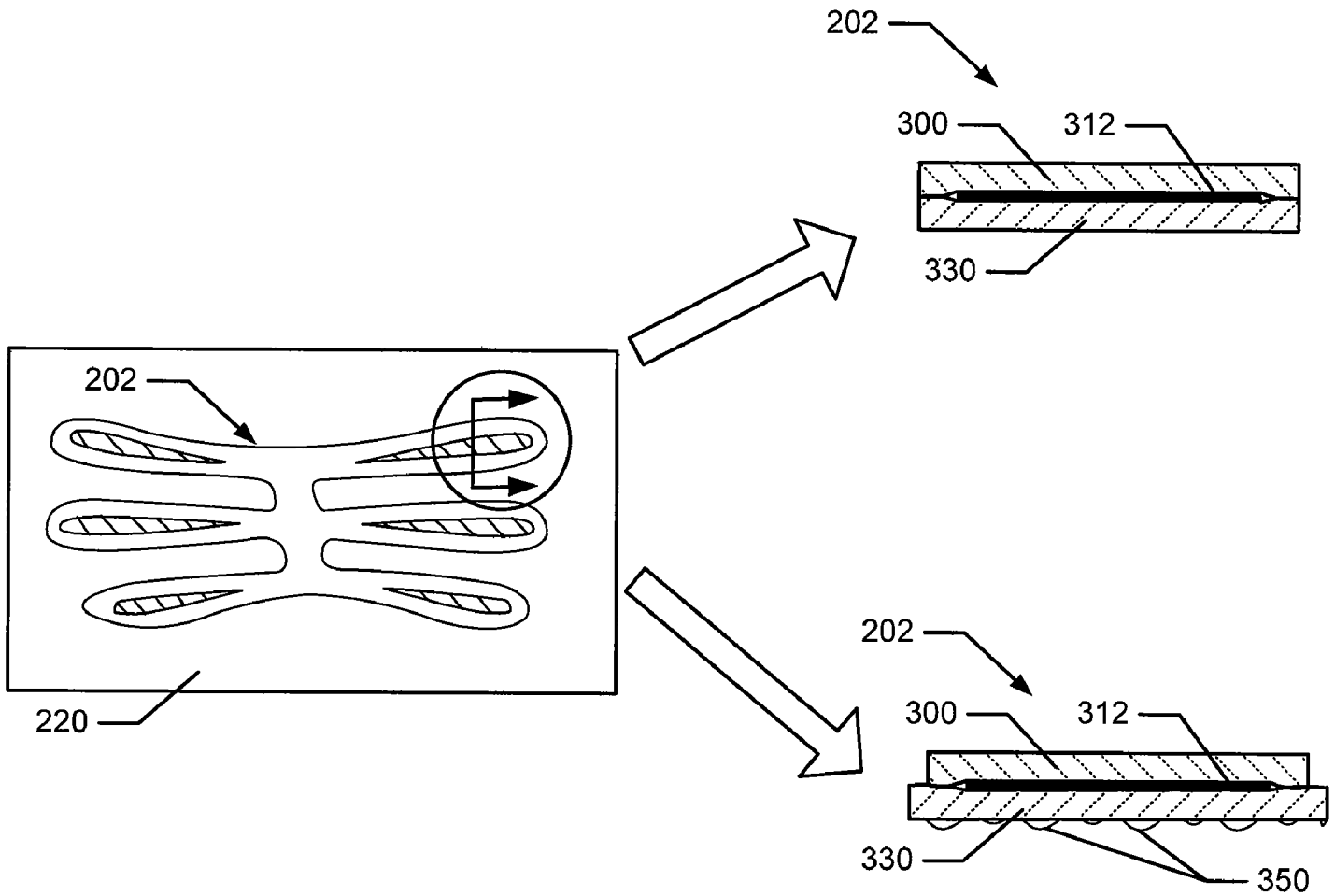
FIG. 4 illustrates cross sectional views of example body position feedback systems according to some examples of this invention.

FIG. 4 illustrates cross sectional views of various examples of attachable body position feedback systems in accordance with this invention, e.g., of the multi-layer types described above in conjunction with FIGS. 2A through 3F. The upper cross sectional view in FIG. 4 illustrates the body position feedback system 202 in which the first material layer 300 and the base layer 330 are substantially the same size and shape, and the second material layer 312 is sandwiched between these layers. As illustrated in the upper portion of FIG. 4, the second material layer 312 is somewhat smaller than the other layers, which leaves the outer edges of the first material layer 300 and the base layer 330 exposed so they may be joined together with one another (e.g., by adhesives or cements, by lamination techniques, by stitching or sewing, etc.). The bottom cross sectional view in FIG. 4, on the other hand, shows the base layer 330 somewhat larger than the first material layer 300 (and extending beyond the first material layer 300). The first material layer is somewhat larger than the second material layer 312 (and the second material layer 312 is sandwiched between the first material layer 300 and the base layer 330). Again, any desired method of joining the various layers together may be used without departing from this invention including the methods described above in conjunction with the upper cross sectional portion of FIG. 4. This structure, if desired, may be used to produce a body position feedback system 202 having a tackle twill type appearance in its final structure.

FIG. 4 illustrates another optional feature that may be included in garments structures and/or body position feedback systems in accordance with at least some examples of this invention. As illustrated in the bottom cross sectional view of FIG. 4, one or more layers of the body position feedback system 202 may include "texturing" features or elements. The texturing is shown in FIG. 4 by raised areas 350 extending from the bottom of base layer 330. Texturing of this type may further enhance the wearer's "feel" of the body position feedback system 202, better stimulate the nerves and deep tissue receptors, etc. The raised areas 350 may be provided on any desired surface or layer of the body position feedback system 202 (and/or on any portion thereof), and they may be any desired size or shape (e.g., raised at least 1 mm, at least 2 mm, at least 3 mm, at least 5 mm, or even at least 8 mm, with respect to the base surface level of the layer with which they are included (e.g., layer 330 in FIG. 4)). The raised areas 350 may be integrally formed as part of the layer structure 330 (e.g., molded or embossed therein) or applied thereto as separate elements (e.g., printed thereon, silicone dot elements applied thereto, mechanical fastener elements or portions thereof (e.g., male snap elements), etc.). While the texturing 350 may be uniformly and evenly applied across the layer of material, it also may be concentrated at specific locations, including present in multiple, discrete locations at one or more portions of the layer of material to which it is applied.

Figure 5B:
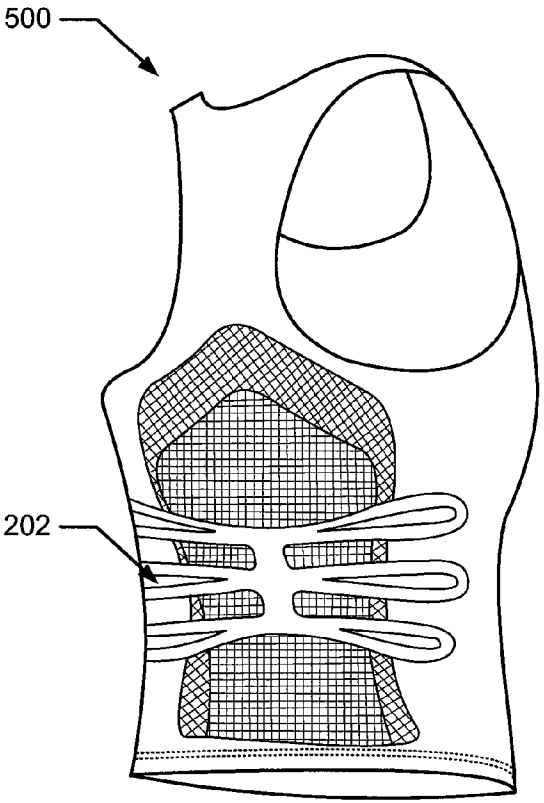
FIGS. 5A through 9 illustrate various examples of different garment structures and/or lower back position feedback systems in accordance with this invention.
Figure 5A:
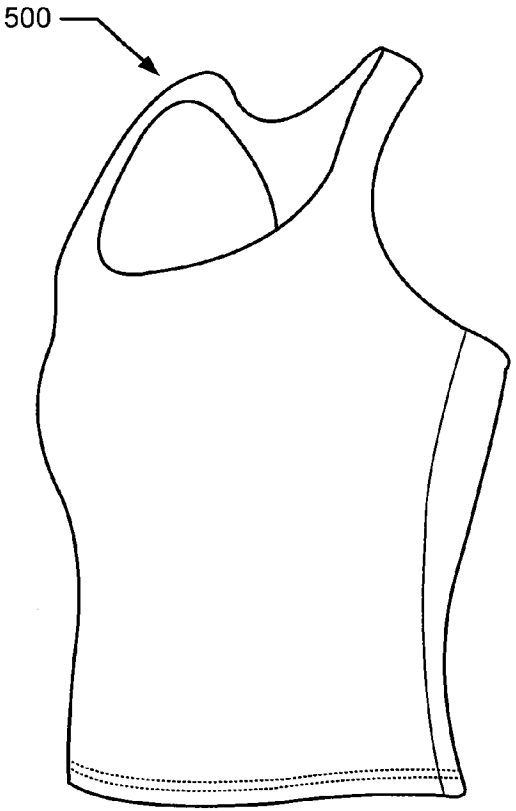
Figure 6B:
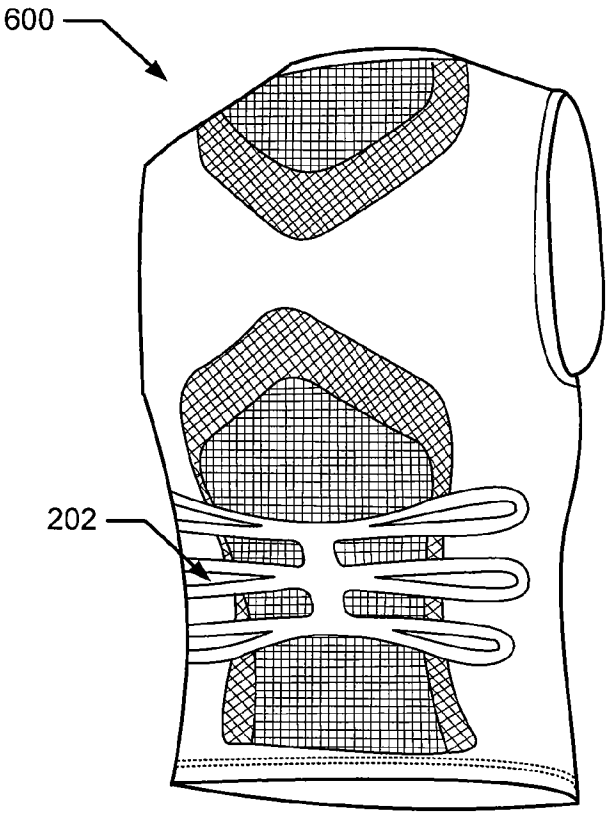
Figure 6A:
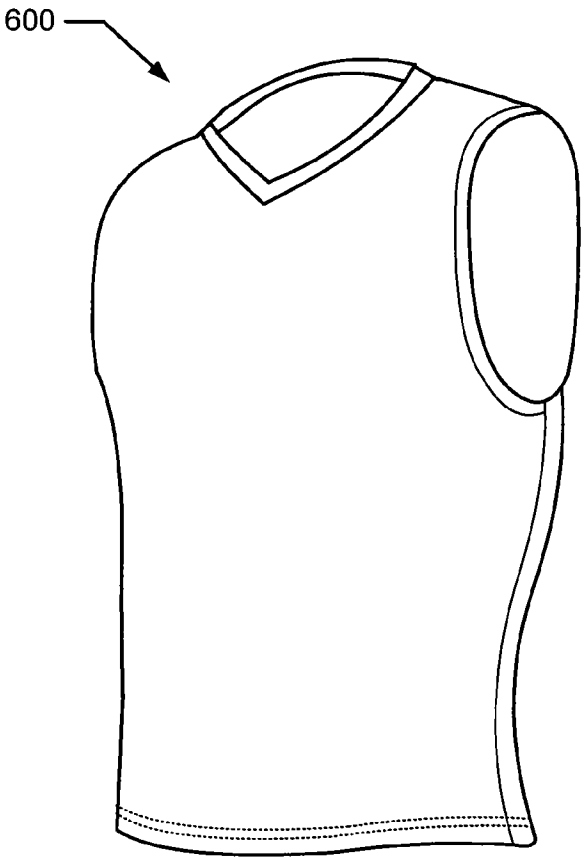
Figure 7B:
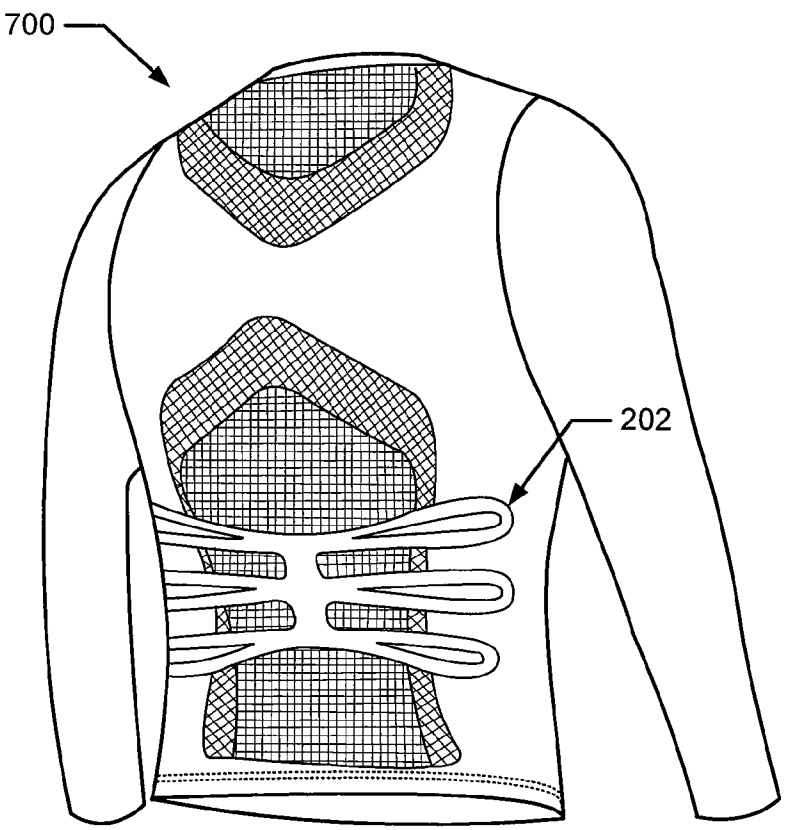
Figure 7A:
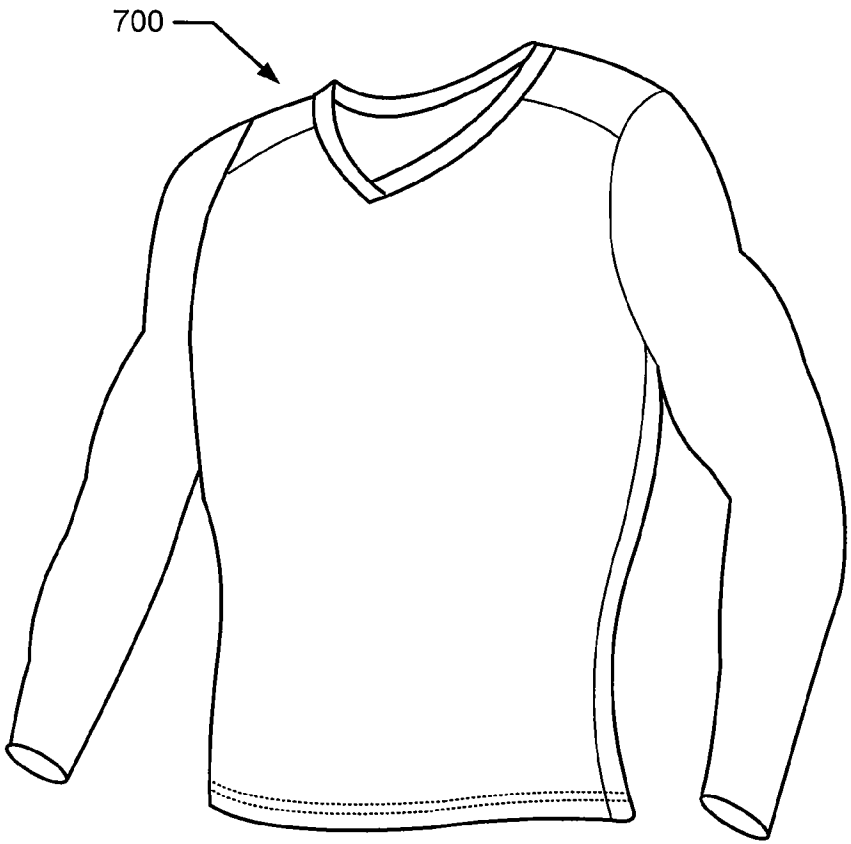

Aspects of this invention may be used in conjunction with any desired garment type or style without departing from this invention. Various examples of inclusion of a lower back position feedback system 202 in garment structures are illustrated in conjunction with FIGS. 5A through 7B. Specifically, FIGS. 5A and 5B illustrate inclusion of a lower back position feedback system 202 in a tank top or sports bra type garment structure 500. FIGS. 6A and 6B illustrate inclusion of a lower back position feedback system 202 in a vest type garment structure 600. FIGS. 7A and 7B illustrate inclusion of a lower back position feedback system 202 in a long sleeve form fitting garment structure 700.

Lower back position feedback apparatuses in accordance with this invention also need not be confined to the specific structures shown and described above in conjunction with FIGS. 2A through 7B. Rather, for example, the multilayer construction may be changed to have more or fewer layers without departing from this invention. Alternatively, if desired, a single layer structure having a higher resistance to stretching, such as layer 300 described above (with or without openings 306), may be provided and engaged with a garment structure as a complete body position feedback system without departing from this invention.

Figure 9:
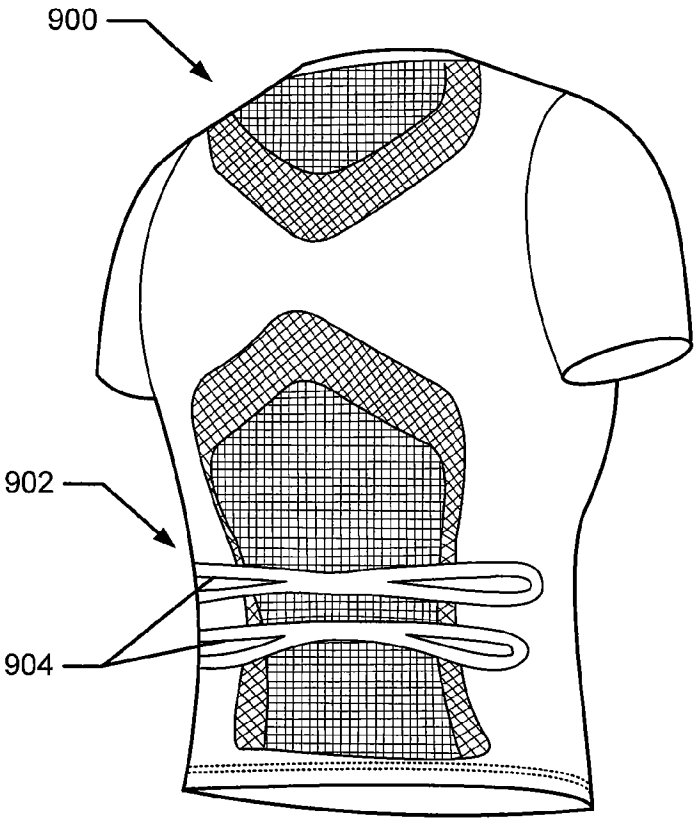
Figure 8:
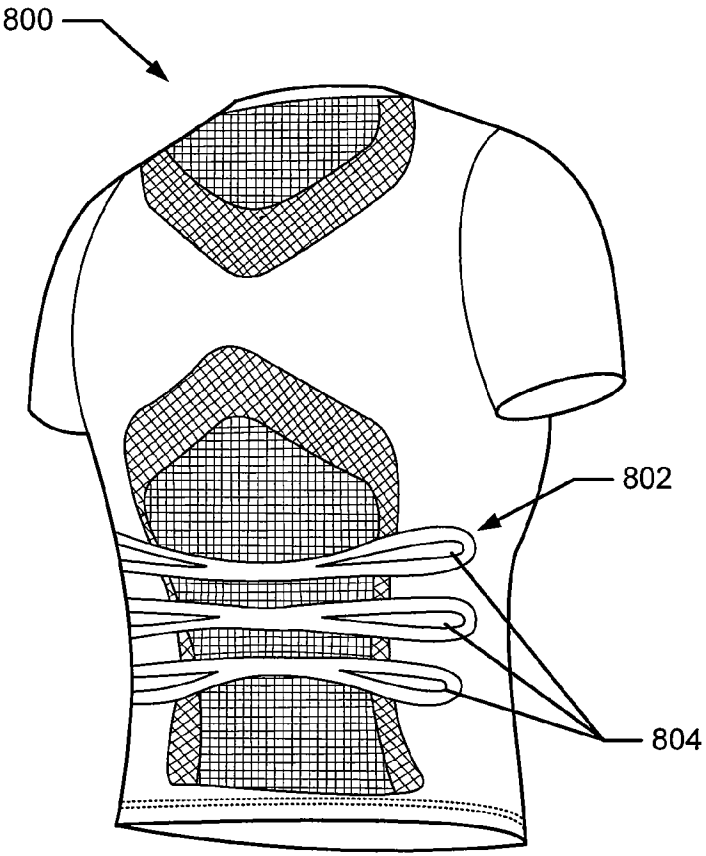

The shape of the body position feedback system also may be varied widely without departing from this invention (e.g., to provide a desired shape for inclusion in a desired garment structure and engaging a desired body portion whose position is to be better sensed). Optionally, the body position feedback system will include a structure of higher stretch resistant material (or compressive force applying material) that at least partially wraps around the body part(s) for which enhanced positioning feedback is desired. Other variations also are possible. FIGS. 8 and 9 illustrate example garment structures 800 and 900, respectively that include body position feedback systems 802 and 902, respectively. Each of these feedback systems 802 and 902 includes plural independent regions (804 and 904) having a higher resistance to stretching as compared to the stretching resistance for the fabric element making up the largest proportion of the garment structure and/or as compared to the stretching resistance for the fabric element(s) that they cover. In these structures 802 and 902, however, the regions 804 and 904 remain separate from and unconnected with one another. If desired, some of the higher compressive force applying regions 804 and/or 904 can be interconnected with a base region, e.g., in the manner described above in conjunction with FIG. 2B. Any desired number of interconnected and unconnected higher compressive force applying regions may be provided in a garment structure, at any desired positions and/or spacings, without departing from this invention. Interconnecting base regions, when present, may be located at any position along the lengths of the regions 802 and 902, not just at the center spinal area. The body position feedback systems 802 and 902 also may be oriented to extend at any desired angles or directions across the body, including at the same or different angles or directions, to target any desired areas or regions of the back (e.g., one or more specific vertebrae, etc.), without departing from this invention.

Figure 10B:
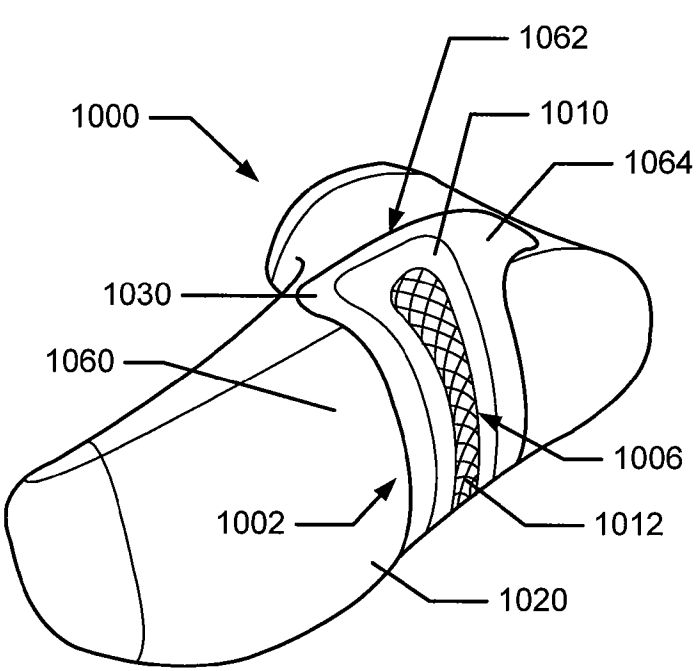
FIGS. 10A and 10B illustrate an example garment structure including a foot position feedback system according to one example of this invention.
Figure 10A:
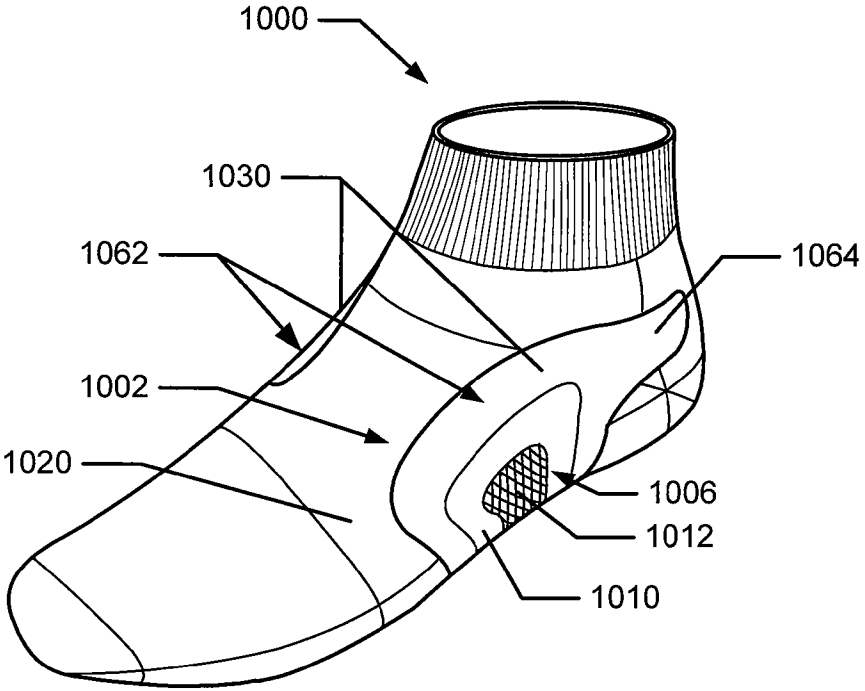

As mentioned above, this invention is not limited to garment structures for enhancing wearer feel and/or awareness of the positioning of the lower back. Foot positioning and movement during athletic performances (e.g., during a golf swing, in a golf stance, etc.) can be important factors in performance and/or achieving repeatable and reliable capabilities. FIGS. 10A and 10B illustrate an example sock structure 1000 that includes a multilayer body position feedback system 1002, e.g., of the types generally described above in conjunction with FIGS. 2A through 9B. More specifically, this illustrated example foot position feedback system structure 1002 includes a base layer 1030 that directly engages the fabric elements 1020 of the sock structure 1000. The illustrated example foot position feedback system structure 1002 further includes a second material layer 1012 (e.g., a mesh or lightweight material layer) sandwiched between the base layer 1030 and an overlying top/first material layer 1010 that includes an opening 1006 defined therein through which the second material layer 1012 is exposed. The base layer 1030 and/or the first material layer 1010 in this structure 1002 may have a higher resistance to stretching (or compressive force applying capability) as compared to that for the fabric element 1020 making up the largest proportion of the garment structure 1000 and/or as compared to that of the fabric element(s) that it overlays. The various parts of this multilayer structure 1002 may have the same or similar characteristics, may be made from the same or similar materials, and/or may be engaged together with one another and with the garment structure 1000 in the same or similar manner, as those features described above in relation to FIGS. 2A through 9B.

Notably, in this example structure 1000, the higher compressive force applying material(s) 1030 and/or 1010 extend continuously from the lateral side, across the footbed 1060, and to the medial side of the garment structure (e.g., these parts extend continuously in the specified direction for at least 2 inches, and in some examples at least 3 inches, at least 4 inches, at least 6 inches, or even more). In this manner, placing weight on the foot will tend to apply opposing forces against the ends 1062 of the foot position feedback system 1002. The higher stretch resistance of at least one layer of the feedback system 1002 applies a compressive force against the wearer's foot (e.g., the arch, the sides, etc.) or a resistance to the tensile weight force, thereby increasing the wearer's "feel" of the foot and increasing his or her awareness of the position of this portion of the foot.

This illustrated example foot position feedback system 1002 includes further (optional) features. Ankle and/or heel positioning and/or location can be important for some activities (such as building a repeatable golf posture or stance). Therefore, the ends 1062 of the foot position feedback system 1002 in this structure 1000 include additional high stretch resistant materials extending away from the arch area (and away from the opening 1006) and toward the rear of the garment structure 1000. These extended portions or "wing areas" 1064 extend along the ankle and/or heel area of the garment structure to increase the local compressive force and/or stretch resistance at these positions. These areas of higher stretch resistance help increase the wearer's "feel" of the foot and/or his or her awareness of the position of this portion of the foot, e.g., during twisting action involved in a golf swing.

When present, a wing area 1064 may be provided on either or both of the lateral and medial sides of the garment structure 1000, and these wing areas 1064 may appear the same or different without departing from this invention. Additionally, if desired, the wing areas 1064 may extend any desired distance around the heel area of the garment structure 1000, including somewhat behind the heel. As yet another alternative, if desired, the two wing areas 1064 (when two are present) may join together at the rear heel area and/or integrally form a single continuous wing area 1064 that extends around the rear of the heel from one end 1062 of the foot position feedback system 1002 to the other.

In this illustrated example structure 1000, the wing areas 1064 extend from (and are integrally formed as part of) the base layer 1030, which, as noted above, may constitute a higher stretch resistant material than the material making up the largest proportion of the garment structure and/or the material being covered by base layer 1030. This is not a requirement. Alternatively (or additionally), if desired, one or both wing areas 1064 (when present) may be formed as an extension from the first material layer 1010. As yet additional examples, if desired, the wing area(s) 1064 may constitute separate high stretch resistant materials that may be connected to or separated from the base layer 1030 and/or the first material layer 1010.

Body position feedback systems need not constitute separate structures (such as multilayer laminates or other separate structures) that are engaged with an existing and complete garment structure. Rather, if desired, such structures may be formed as an integral part of the garment's structure without overlaying other material or fabric elements making up the garment. For example, if an outer periphery of the feedback system (like element 202 of FIG. 4) was made of a material that could be sewn, the feedback system 202 may be directly incorporated into the garment structure, e.g., like a separate fabric element and/or as a replacement for all or part of a fabric element from a conventional garment structure.

The body position feedback system, however, need not be a separate structure at all from the garment. Rather, if desired, in accordance with at least some examples of this invention, the body position feedback system may be integrally incorporated into the garment structure as part of one or more of the fabric elements making up the garment structure. Various examples of such systems will be described in more detail below in conjunction with FIGS. 11 through 14E.

Figure 11:
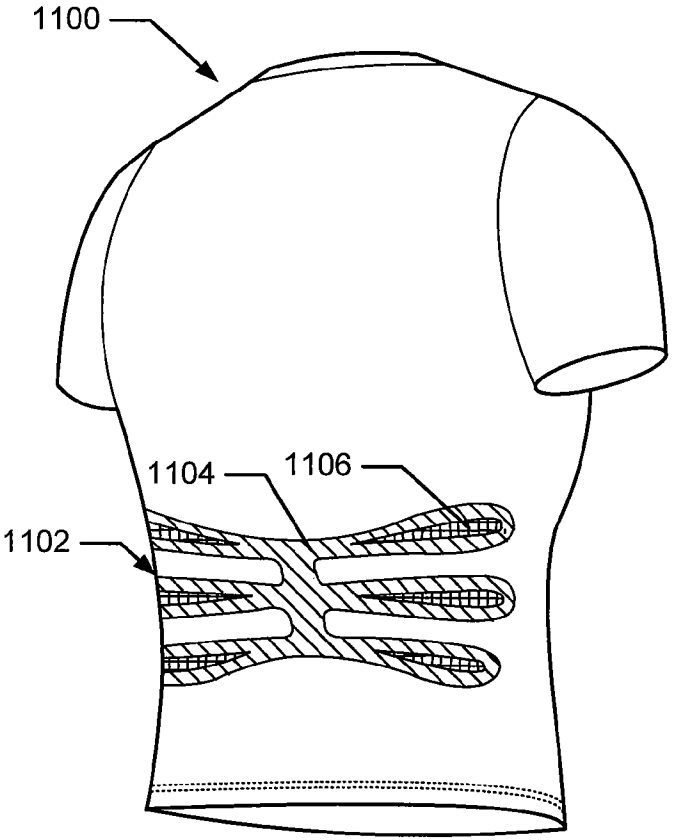

FIG. 11 illustrates an example garment structure 1100 have a lower back position feedback system 1102. If desired, this lower back position feedback system generally may have the same sizes, shapes, and/or locations as the various separately engaged feedback systems described above in conjunction with FIGS. 2A through 9B. In this example structure 1100, however, the higher stretch resistance (compressive force application) for the feedback system 1102 is provided by forming that portion of the garment as a different structure in some manner from the structure making up the largest proportion of the garment structure 1100. This change in structure may be accomplished in a variety of ways.

As some more specific examples, a different (and relatively high stretch resistant) structure may be provided in the regions of the feedback system 1102 (as compared to the stretch resistance for a structure making up the largest proportion of the overall garment structure 1100) by providing different stitching, weaving, and/or knitting patterns at the location of the feedback system region as compared to a stitching, weaving and/or knitting pattern making up the largest proportion of the garment structure. Modern and commercially available knitting machines and systems are known in the art that are capable of forming various types of stitches within a single textile structure (e.g., to produce different stitching patterns having different elasticities and/or different stretchabilities or other characteristics). In general, such conventional knitting machines and systems may be programmed to alter a design on the textile structure through needle selection. More specifically, the type of stitch formed at each location on a textile structure may be selected by programming a knitting machine such that specific needles either accept or do not accept yarn at each stitch location. In this manner, various patterns, textures, or designs may be selectively and purposefully imparted to a unitary textile structure to thereby form regions having different elasticity, different stretchability, and/or different compressibility properties.

As another example, the structure of a region of a garment structure may be altered to provide a higher stretch resistance (in the region for the feedback system 1102) as compared to that of the largest proportion of the garment structure by using a different material in the high stretch resistant region as compared to the material making up the largest proportion of the garment structure. Modern and conventional knitting machines and systems of the types described above also may be programmed to utilize a specific type of yarn material for each stitch. That is, the type of yarn utilized at each location on the textile structure may be selected by programming the knitting machine such that specific needles accept a particular type of yarn at each stitch location. In this manner, yarns and/or materials having different stretch characteristics may be incorporated into a unitary garment structure to thereby form regions having different elasticity, different stretchability, and/or different compressibility properties.

A different structure may be provided for the region of a garment structure so as to provide a higher stretch resistance (in the region for the feedback system 1102) as compared to that of the largest proportion of the garment structure by using and/or forming a thicker material in the fabric element and/or area of the higher stretch resistance as compared to a thickness of the material making up the largest proportion of the garment structure. This change in thickness may be accomplished, for example, by using heavier yarn materials or creating a more "built up" structure at the higher stretch resistant region as compared to other regions. Additionally or alternatively, if desired, the increased thickness may be provided at plural discrete locations within the higher stretch resistant region, e.g., to thereby also provide texturing and/or an uneven surface for the fabric element (e.g., alternating thick and thin portions) at the location(s) of the higher stretch resistance. This texturing feature can create the structures and further enhance the feel properties for the wearer, as described above in conjunction with FIG. 4.

As shown in FIG. 11, the knitting and/or other features of the garment structure 1100 may be selectively altered such that the higher compressive force applying region 1102 has multiple areas 1104 and 1106 having different stretch resistances. Areas 1106 in FIG. 11 may have a higher or lower stretch resistance as compared to area 1104 without departing from this invention. Alternatively, if desired, the entire region 1102 may be made from a single material structure and/or designed to have essentially the same stretch resistance throughout (a stretch resistance that is higher than that of the material and/or structure making up the largest proportion of the garment structure and/or that of the immediately surrounding fabric elements). The different hatching in region 1102 depict areas 1104 and 1106 of the garment 1100 having different structures (e.g., in one or more of the ways described above). Nonetheless, these areas of different structure, and indeed the entire higher compressive force applying region 1102, may be integrally formed as a one piece construction with the fabric elements making up the remainder of the garment structure 1100.

Figure 12:
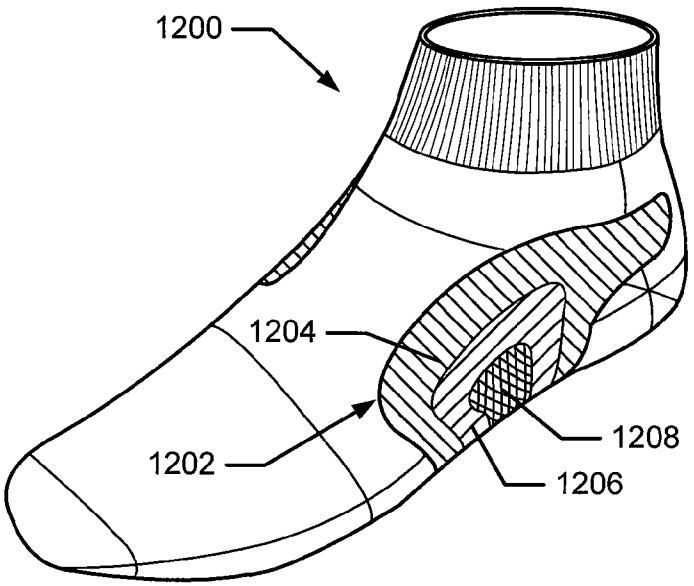
FIGS. 11 and 12 illustrate example garment structures having integrally formed body position feedback systems.

FIG. 12 illustrates an example sock structure 1200 having a foot position feedback system 1202. While this illustrated example foot position feedback system 1202 generally has the same size, shape, and location of the structures described above in conjunction with FIGS. 10A and 10B, in this instance, the foot position feedback system 1202 (having a higher stretch resistance or compressive force application capability than that associated with a largest proportion of the garment structure and/or the immediately surrounding fabric elements) is provided using different fabric structures (e.g., different stitching, weaving, and/or knitting patterns; different materials; different material thicknesses and/or texturing; etc., in the various manners described above in conjunction with FIG. 11). While any desired number of areas having different moduli of elasticity, stretchability, and/or compression properties may be included in the structure 1202 without departing from this invention, in this illustrated example, the foot position feedback system 1202 includes three discrete regions of different stretch resistance, namely regions 1204, 1206, and 1208. Also, the various discrete regions 1204, 1206, and 1208 having different stretch resistances within system 1202 may have any desired arrangement of relative stretch resistance with respect to one another (e.g., higher stretch resistance as one moves inward from region 1204 to 1208, highest stretch resistance in region 1206 and lowest in region 1208, etc.).

Figure 13B:
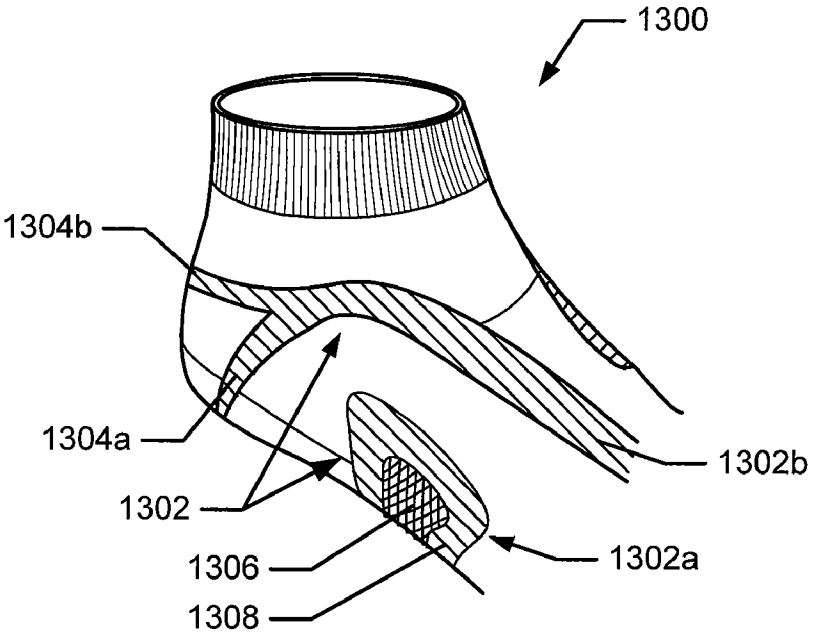
FIGS. 13A through 14E illustrate additional example garment structures including foot position feedback systems according to examples of this invention.
Figure 13A:
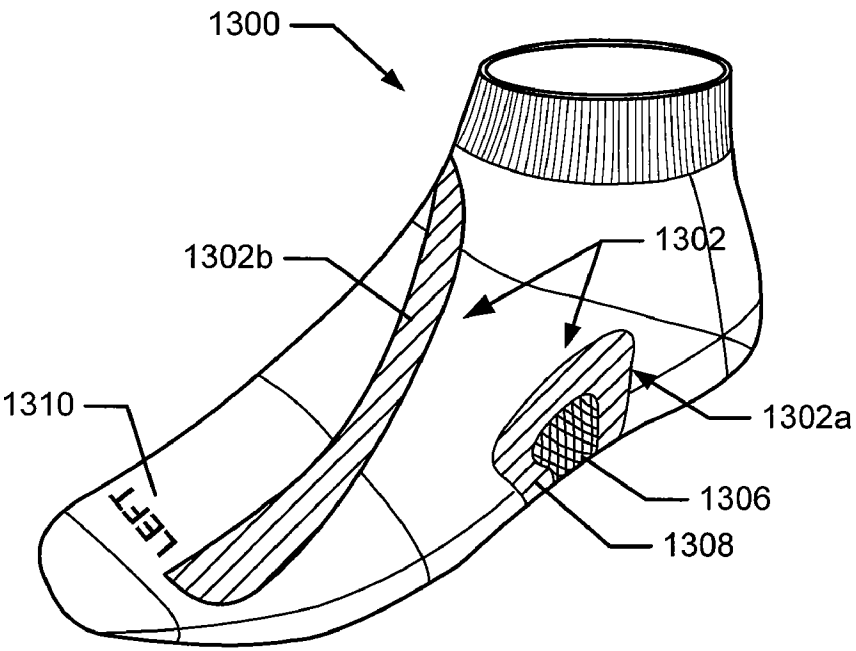
Figure 14C:
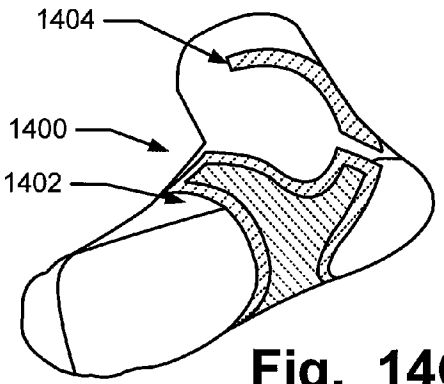
Figure 14B:
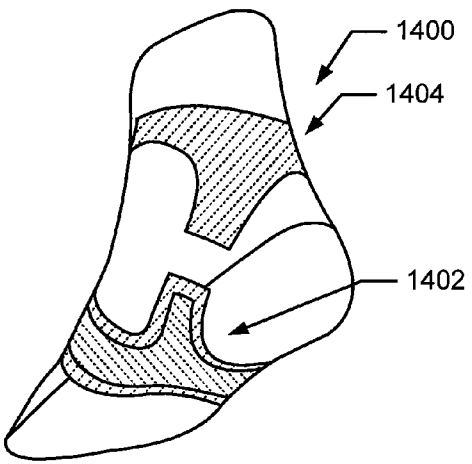
Figure 14A:
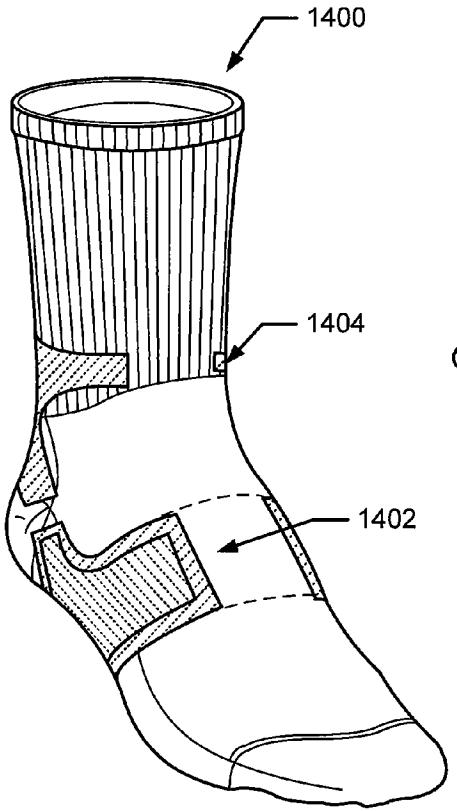
Figure 14E:
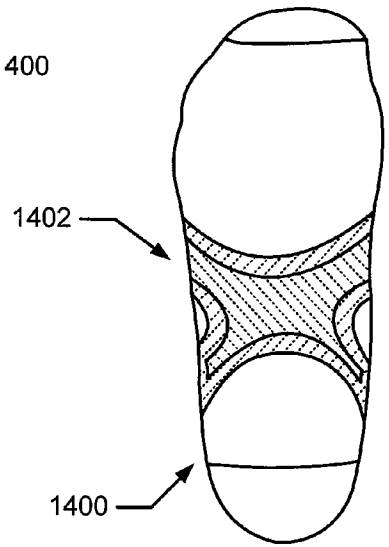
Figure 14D:
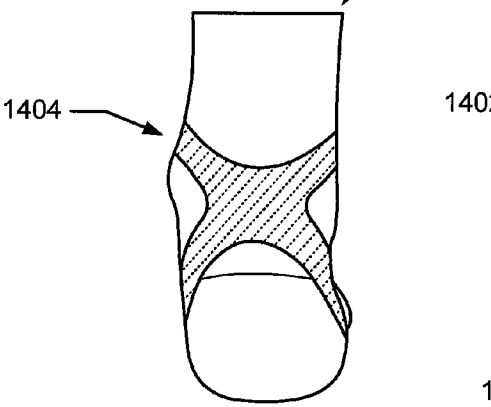

Another example garment structure 1300 including a foot position feedback system 1302 integrated into the garment structure (e.g., by different material structures) is illustrated in FIGS. 13A and 13B. In this example structure 1300, the foot position feedback system 1302 includes two separated portions, namely, arch position feedback portion 1302*a* (extending across the footbed in the arch area, from the lateral side to the medial side of the garment structure 1300) and instep/heel/ankle position feedback portion 1302*b* (extending from the lateral toe area of the garment structure, diagonally across the instep area, and to the medial heel/ankle area). At the medial heel/ankle area, the feedback portion

1302*b* forks into two separate end portions 1304*a* and 1304*b*, one portion 1304*a* extending below the heel (to the bottom footbed portion) and one portion 1304*b* extending around the rear heel to the back of the garment. The arch position feedback portion 1302*a* helps make the wearer better aware of his/her weight distribution and the position/movement of the arch area and other portions of the foot, e.g., in a manner similar to the structures described above in conjunction with FIGS. 10A and 10B. The instep/heel/ankle position feedback portion 1302*b* helps wearers become more aware of the positioning and movement of the instep, ankle and heel.

The diagonal structure of the instep/heel/ankle position feedback portion 1302*b* (from the lateral toe to the medial heel/ankle area) helps wrap this high compressive force applying region around the ankle area and across the instep area, which move during foot movement and athletic activities. This movement acts against the compressive force and/or relatively low stretchability of the high compressive force applying region 1302*b* and helps make the wearer more aware of the instep/ankle/heel position and movement. Because of its non-symmetric structure, this example garment structure 1300 further includes a "correct foot indicator" 1310 to let the user know whether this sock should be placed on the right or left foot.

The various parts of this foot position feedback system 1302 may be provided with any desired relative stretch resistances (or compressive force applying capabilities) without departing from the invention. For example, the interior 1306 of region 1302*a* may have the highest stretch resistance, and regions 1308 and 1302*b* may have the same or different stretch resistances (and less than that of region 1306). All three of these regions 1302*b*, 1306, and 1308 in this example structure 1300 have a higher stretch resistance than that of the material making up the largest proportion of the garment structure 1300 and that of the immediately surrounding fabric element(s). Additionally or alternatively, the stretch resistance (or compressive force applying capability) may vary within a given region, e.g., a higher stretch resistance may be incorporated into the structure along one or more portions of the length of region 1302*b*, such as at or toward the forked end 1304*a*/1304*b*.

The illustrated example structure 1300 of FIGS. 13A and 13B, including all portions of the foot position feedback system 1302 (having higher stretch resistance than that associated with a largest proportion of the garment structure), may be integrally formed in the garment structure, for example, using different fabric structures (e.g., different stitching, weaving, and/or knitting patterns; different materials; different material thicknesses and/or texturing; etc., in the various manners described above in conjunction with FIG. 11). This is not a requirement. Rather, if desired, one or more of the higher stretch resistant areas 1302*a*, 1302*b*, 1304*a*, 1304*b*, 1306, and/or 1308 may be provided by attaching a separate high stretch resistant element to the garment structure, e.g., in the manner described above in conjunction with FIGS. 2A through 10B.

FIGS. 14A through 14E illustrate another example foot-position awareness enhancing garment structure 1400 in accordance with this invention. This example garment structure 1400 includes a "crew sock" type garment that extends higher on the ankle and calf as compared to the previously described garments. This garment 1400 includes two separate high compressive force applying regions, namely region 1402 around the arch area and region 1404 around the ankle and calf areas. These regions 1402 and 1404 may be integrally formed as part of the fabric structure of the garment 1400 or they may be separate structures attached to the garment 1400.

The example garment structure 1400 of FIGS. 14A through 14E illustrates that the two regions 1402 and 1404 do not necessarily have the same compressive force application capabilities (as illustrated by the different hatching in the figures). While in this illustrated example structure 1400 region 1402 may have a higher compressive force application capability than region 1404, this is not a requirement. Rather, if desired, the two regions may have the same compressive force application capabilities or region 1404 may have a higher compressive force application capability than region 1402. Also, any desired number of regions and/or any desired number of different compressive force application capabilities may be provided in a given garment structure without departing from this invention. Also, if desired, both socks of a pair may have the same or different compressive force application structures and/or capabilities without departing from this invention.

Figure 15:
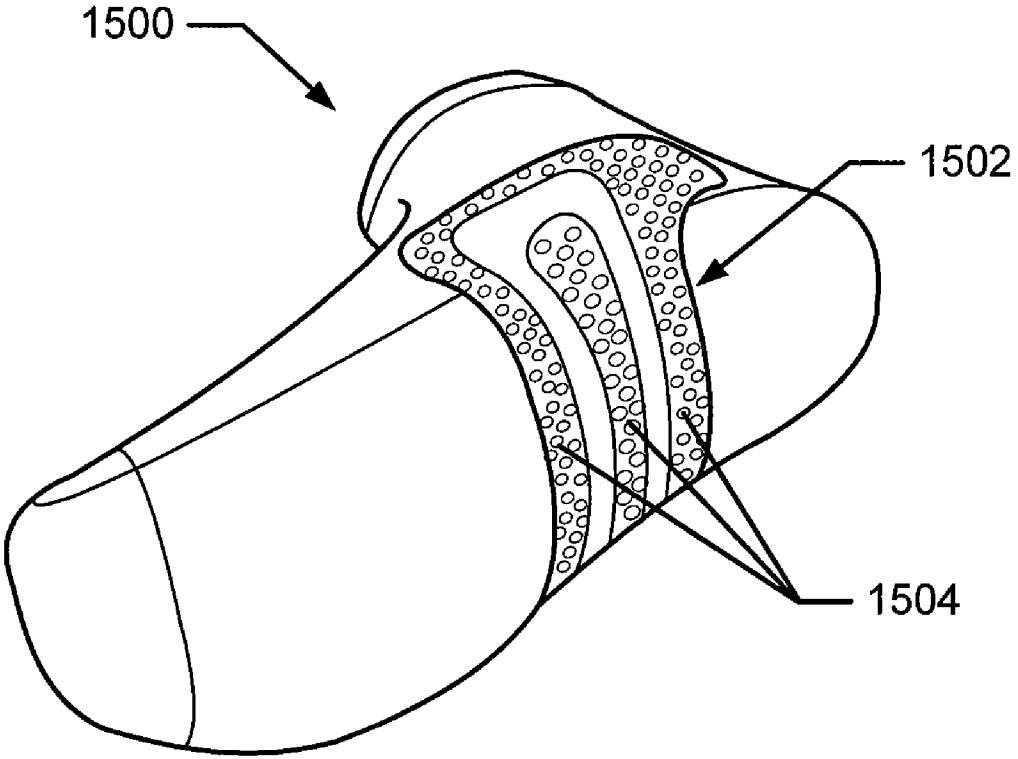
FIG. 15 illustrates another example garment structure according to this invention that includes texturing as part of the body position feedback system.

FIG. 15 illustrates another example garment structure 1500 in accordance with aspects of this invention. This body position feedback region 1502 is similarly shaped and located to those described above in conjunction with FIGS. 10A, 10B, and 12, and the region 1502 may be provided using any of the methods described above. Any desired shape for the region 1502 (including multiple separate regions) may be used without departing from this invention. In this example structure 1500, however, at least some portions of the body position feedback region 1502 include texturing elements 1504. As described above, the texturing elements 1504 may be separately engaged with the garment structure 1500 or the region 1502, and/or they may be integrally formed in the garment structure 1500 at the desired regions using the garment production process (e.g., knitting the garment structure 1500 at selected locations using heavier threads, using a thicker knitting or stitching pattern, etc.). Texturing of this type can further enhance the wearer "feel" and awareness of his or her body position. Optionally, if desired, this texturing may be used in combination with the compressive force and/or tensile stretch resistance of high modulus of elasticity regions, as described above. Alternatively, if desired, texturing alone can be used to increase wearer feel and/or body positioning awareness (e.g., without the need for high stretch resistant regions).

Foot-containing structures or leg-containing structures in accordance with at least some examples of this invention (such as socks like those illustrated in FIGS. 10A, 10B, and 12-15) also may be useful to alter characteristics of a wearer's gait or stance. By increasing the wearer awareness of foot positioning at various times during a stride and/or while standing, a wearer may adjust his or her gait during a step and/or adjust his or her standing position. Depending on the positioning and/or other characteristics of the high compressive force application regions in the sock (or other garment structure), such garments may be used to help correct pronation, suppination, and/or other gait/stance related issues and/or otherwise provide foot or leg stance and/or motion control.

III. Conclusion

The present invention is described above and in the accompanying drawings with reference to a variety of example structures, features, elements, and combinations of structures, features, and elements. The purpose served by the disclosure, however, is to provide examples of the various features and concepts related to the invention, not to limit the scope of the invention. One skilled in the relevant art will recognize that numerous variations and modifications may be made to the embodiments described above without departing from the scope of the present invention, as defined by the appended claims. For example, the various features and concepts described above in conjunction with FIGS. 1 through 15 may be used individually and/or in any combination or sub-combination without departing from this invention.

Additionally, aspects of this invention can be extended to use with other garment structures and garment structures designed for providing feedback information for different targeted areas of the body (e.g., any of the zones illustrated in FIG. 1). As some more specific examples, aspects of this invention may be extended for use with garment structures specifically designed and tailored to provide position feedback information to the wearer relating to positioning of at least portions of the hands, feet, ankles, calves, knees, arms, elbows, shoulders, sacrum or other portions of the back, core, hips, neck, etc. Any type of garment structure that tightly fits against or around and/or at least partially contains one or more of these portions of the body may be provided in accordance with examples of this invention. Also, garment structures incorporating aspects of the invention may be developed for use in a wide variety of sports, athletic performances, and/or other activities, including any activity where proper body posture, movement, and/or positioning may affect performance and/or development of "muscle memory" may enhance performance. Examples of such sports and/or activities include but are not limited to: golf, baseball, softball, cricket, basketball, football, hockey, skiing, snow boarding, rowing sports, sailing, weightlifting, sprinting, running, jogging, walking, gymnastics, cycling, skateboarding, soccer, swimming, tennis, yoga, dance, volleyball, bobsledding, luge, lacrosse, etc.

We claim:

1. An article of apparel, comprising:

a garment structure for a human foot, wherein the garment structure includes one or more fabric elements, and wherein the garment structure is structured and arranged so as to provide a close fit to and completely contain an instep portion of the foot; and a foot position feedback system integrally formed in the garment structure at the instep portion, wherein the foot position feedback system includes a first region that extends across the instep portion of the garment structure, wherein the first region has a higher compressive force application capability than a compressive force application capability of the fabric element making up a largest proportion of the garment structure, wherein the first region extends across the instep portion from a lateral toe area to a medial heel or medial ankle area of the garment structure, wherein the first region includes a terminal end at the lateral toe area, wherein the foot position feedback system includes a second region that extends across the arch portion from a medial side of the garment structure, across a footbed portion of the garment structure, and to a lateral side of the garment structure, wherein the second region has a higher compressive force application capability than a compressive force application capability of the fabric element making up a largest proportion of the garment structure.

2. An article of apparel according to claim 1, wherein a first portion of the first region extends continuously from a medial side to a lateral side of the garment structure along the instep portion in a diagonal manner.

3. An article of apparel according to claim 1, wherein the first region extends along a medial heel or medial ankle area of the garment structure.

4. An article of apparel according to claim 1, wherein the first region extends beneath a medial heel area to a footbed portion of the garment structure.

5. An article of apparel according to claim 1, wherein at least a majority of the instep portion of the garment structure does not include the foot position feedback system.

6. An article of apparel according to claim 1, wherein the first region has a different structure from a structure making up the largest proportion of the garment structure to thereby provide the higher compressive force application capability, wherein the structure of the first region is different from the structure making up the largest proportion of the garment structure in one or more of the following ways: a different stitching or knitting pattern in the fabric element of the first region as compared to a stitching or knitting pattern making up the largest proportion of the garment structure; a different material in the fabric element of the first region as compared to a material making up the largest proportion of the garment structure; and a different texturing in the fabric element of the first region as compared to a texturing making up the largest proportion of the garment structure.

7. An article of apparel according to claim 1, wherein the second region is spaced from the first region.

8. An article of apparel according to claim 1, wherein the second region extends continuously from the medial side to the lateral side of the garment structure and does not extend across the instep portion of the garment structure.

9. An article of apparel according to claim 1, wherein the foot position feedback system in an increased thickness as compared with the thickness of the fabric element making up a largest proportion of the garment structure.

10. An article of apparel according to claim 1, wherein the second region has a different structure from a structure making up the largest proportion of the garment structure to thereby provide the higher compressive force application capability, wherein the structure of the second region is different from the structure making up the largest proportion of the garment structure in one or more of the following ways: a different stitching or knitting pattern in the fabric element of the second region as compared to a stitching or knitting pattern making up the largest proportion of the garment structure; a different material in the fabric element of the second region as compared to a material making up the largest proportion of the garment structure; and a different texturing in the fabric element of the second region as compared to a texturing making up the largest proportion of the garment structure.

11. An article of apparel, comprising:

a garment structure for a human foot, wherein the garment structure includes one or more fabric elements, and wherein the garment structure is structured and arranged so as to provide a close fit to and completely contain an instep portion of the foot; and a foot position feedback system integrally formed in the garment structure at the instep portion, wherein the foot position feedback system includes a first region that extends across the instep portion of the garment structure, wherein the first region has a higher compressive force application capability than a compressive force application capability of the fabric element making up a largest proportion of the garment structure, wherein the first region extends across the instep portion from a lateral toe area to a medial heel or medial ankle area of the garment structure, wherein the first region includes a terminal end at the lateral toe area, wherein a first branch of the first region extends beneath a medial heel area to a footbed portion of the garment structure and a second branch of the first region extends along the medial heel or ankle area to a rear heel portion of the garment structure.

12. A sock, comprising:

a garment structure for a human foot, wherein the garment structure includes one or more fabric elements, and wherein the garment structure is structured and arranged so as to provide a close fit to and completely contain an instep portion of the foot; and a foot position feedback system integrally formed in the garment structure at the instep portion, wherein the foot position feedback system includes a first region that extends across the instep portion of the garment structure, wherein the first, region has a higher compressive force application capability than a compressive force application capability of the fabric element making up a largest proportion of the garment structure, wherein the foot position feedback system includes a separate and distinct second region that is spaced from the first region by at least a portion of the fabric element making up a largest proportion of the garment structure and extends across the arch portion from a medial side of the garment structure, across a footbed portion of the garment structure, and to a lateral side of the garment structure, wherein the second region has a higher compressive force application capability than a compressive force application capability of the fabric element making up a largest proportion of the garment structure, wherein a first branch of the first region extends beneath a medial heel area to a footbed portion of the garment structure and a second branch of the first region extends along the medial heel or ankle area to a rear heel portion of the garment structure.

13. An article of apparel according to claim 12, wherein the second region extends continuously from the medial side to the lateral side of the garment structure and does not extend across the instep portion of the garment structure.

14. An article of apparel according to claim 12, wherein the foot position feedback system has an increased thickness as compared with the thickness of the fabric element making up a largest proportion of the garment structure.

15. An article of apparel according to claim 12, wherein at least a majority of the instep portion of the garment structure does not include the foot position feedback system.

16. An article of apparel according to claim 12, wherein the first region has a different structure from a structure making up the largest proportion of the garment structure to thereby provide the higher compressive force application capability, wherein the structure of the first region is different from the structure making up the largest proportion of the garment structure in one or more of the following ways: a different stitching or knitting pattern in the fabric element of the first region as compared to a stitching or knitting pattern making up the largest proportion of the garment structure; a different material in the fabric element of the first region as compared to a material making up the largest proportion of the garment structure; and a different texturing in the fabric element of the first region as compared to a texturing making up the largest proportion of the garment structure.

17. An article of apparel according to claim 16, wherein the second region has a different structure from a structure making up the largest proportion of the garment structure to thereby provide the higher compressive force application capability, wherein the structure of the second region is different from the structure making up the largest proportion of the garment structure in one or more of the following ways: a different stitching or knitting pattern in the fabric element of the second region as compared to a stitching or knitting pattern making up the largest proportion of the garment structure; a different material in the fabric element of the second region as compared to a material making up the largest proportion of the garment structure; and a different texturing in the fabric element of the second region as compared to a texturing making up the largest proportion of the garment structure.

* * * * *